US007563086B2

(12) United States Patent
Hüttlin

(10) Patent No.: US 7,563,086 B2
(45) Date of Patent: Jul. 21, 2009

(54) OSCILLATING PISTON MACHINE

(76) Inventor: Herbert Hüttlin, Rümminger Strasse 15, 79539 Lörrach (DE)

( * ) Notice: Subject to any disclaimer, the term of this patent is extended or adjusted under 35 U.S.C. 154(b) by 643 days.

(21) Appl. No.: 10/913,277

(22) Filed: Aug. 6, 2004

(65) Prior Publication Data

US 2005/0008515 A1 Jan. 13, 2005

Related U.S. Application Data

(63) Continuation of application No. PCT/EP02/01226, filed on Feb. 6, 2002.

(51) Int. Cl.
*F01C 3/00* (2006.01)
*F03C 2/00* (2006.01)
*F03C 4/00* (2006.01)

(52) U.S. Cl. ..... 418/68; 123/241; 418/270

(58) Field of Classification Search ..... 418/32, 418/35, 68, 270; 123/241
See application file for complete search history.

(56) References Cited

U.S. PATENT DOCUMENTS 3,075,506 A 1/1963 Berry
4,024,841 A * 5/1977 Smith ..... 418/68
6,009,847 A * 1/2000 Huttlin ..... 418/270
6,241,493 B1 6/2001 Turner ..... 418/1

FOREIGN PATENT DOCUMENTS

DE 812949 * 7/1951
DE 19747445 A1 * 5/1999
DE 297 24 399 8/2001
FR 798.793 5/1936
FR 2322282 A * 4/1977
WO WO 98/13583 4/1998

* cited by examiner

*Primary Examiner*—Theresa Trieu
(74) *Attorney, Agent, or Firm*—St. Onge Steward Johnston & Reens LLC

(57) ABSTRACT

An oscillating piston machine comprises a plurality of pistons which are arranged in a housing, rotate together in the housing about an axis of rotation which is essentially central in the housing and is fixed to the housing, and execute reciprocating oscillating movements about a respective oscillation axis as they rotate in the housing, in each case two adjacent pistons executing oscillating movements in opposite directions. The housing is of spherical construction on the inside, the oscillation axes of the pistons being formed by a common oscillation axis which run essentially through the center of the housing.

16 Claims, 19 Drawing Sheets

OSCILLATING PISTON MACHINE

CROSS REFERENCE TO RELATED APPLICATION

The present application is a continuation of international patent application PCT/EP02/01226 filed on Feb. 6, 2002 which designates the United States.

BACKGROUND OF THE INVENTION

The invention relates to an oscillating piston machine, comprising a plurality of pistons which are arranged in a housing, rotate together in the housing about an axis of rotation which is essentially central in the housing and is fixed with respect to the housing, and execute reciprocating oscillating movements about a respective oscillation axis as they rotate in the housing, in each case two adjacent pistons executing oscillating movements in opposite directions.

Oscillating piston machines belong to a generic type of internal combustion engines in which the individual working strokes of the taking in, compression, ignition, expansion and expulsion of the combustion mixture are brought about by reciprocating oscillating movements of the individual pistons between two end positions.

The oscillating pistons rotate here in the housing about a common axis of rotation which is fixed with respect to the housing, the rotating movement of the pistons being converted by means of appropriate intermediate elements into a rotary movement of an output shaft. As the oscillating pistons rotate in the housing, they carry out the reciprocating oscillating movements.

In an oscillating piston machine known from WO 98/13583, the housing has a cylinder geometry on the inside. The pistons of the known oscillating piston machine are embodied as two-armed levers. In each case two adjacent pistons have a rolling engagement with one another. The pistons are each arranged so as to be capable of oscillating about a piston axis which is parallel with a central housing axis which lies on the cylinder axis. The piston axes extend in the direct vicinity of the inner wall of the housing, each piston having its own piston axis. In order to control the oscillating movements of the individual pistons as they rotate in the housing, a cam element which is central in the housing and fixed to the housing is provided, the individual pistons being guided along said cam element.

The individual working chambers which are formed in each case by two adjacent pistons are formed between sides of the pistons facing the inner wall of the housing and the inner wall of the housing.

Although the known oscillating piston machine has proven favorable in terms of its running properties and its torque curve, it can be considered to be a disadvantage of the known oscillating machine that the mass distribution of the pistons is capable of further optimization owing to the housing geometry and the fact that the individual pistons are borne on the inner wall of the housing.

Document U.S. Pat. No. 6,241,493 B1 has disclosed a device for controlling the flow of fluid through a rotation pump, a compressor or a motor. In a spherical housing a first blade rotates which causes at least one second blade to oscillate in a reciprocating fashion between alternately open and closed positions, to be precise the second blade moves away from the first blade and approaches it again in an oscillating movement. The fluid is moved through an inlet in the housing when the second blade approaches the closed position, while the fluid enters the housing when the second blade reaches the open position. One blade carries out a pure rotational movement and no oscillating movement while the other blade is capable of oscillation. This known device is accordingly based on a completely different working principle from that of the previously mentioned oscillating piston machine.

In addition, document DE 297 24 399 U1 discloses a device having at least two rotary pistons which rotate in an annular space and which bound, in their rotation direction, an expansion chamber in the annular space in the forward and backward directions, the rotary pistons being connected via a gearing arrangement to a common torque transmission shaft in such a way that the volume of the expansion chamber is alternately decreased and increased in the direction of rotation. The gearing arrangement has at least one bent cardan phase joint, which is not compensated in terms of its cyclical rotary displacement, between the torque transmission shaft and at least one of the two rotary pistons which bound an expansion chamber. In this known device, in each case two adjacent pistons approach one another and move away from one another by virtue of the fact that the pistons have varying rotational speeds as they rotate in the housing.

SUMMARY OF THE INVENTION

The invention is based on the object of making available an oscillating piston machine of the type mentioned at the beginning which is improved even further with respect to the symmetry of the mass distribution.

According to the invention, an oscillation piston machine is provided, comprising a housing having an inside of spherical construction, a plurality of pistons arranged in said housing, said plurality of pistons being arranged to rotate together in said housing about an axis of rotation which is essentially central in said housing and is fixed with respect to said housing, and to execute reciprocating oscillating movements about a common oscillation axis (32) running essentially through a center of said housing as said pistons rotate in said housing, wherein in each case two adjacent pistons execute oscillating movements in opposite directions.

In the oscillating piston machine according to the invention, the individual pistons which rotate in the housing are accordingly capable of pivoting about a common oscillation axis which lies essentially on a diameter of the spherical housing, as a result of which the pistons have, in contrast to the known oscillating piston machine mentioned at the beginning, a bearing arrangement which is central in the housing. Whereas, in the known oscillating piston machine mentioned at the beginning, the individual pistons are pressed, owing to the centrifugal force as they rotate in the housing, against their oscillation axis bearings which are seated on the inner wall of the housing, the pistons of the oscillating piston machine according to the invention are supported, owing to their central bearing in the housing, toward the center of the housing against the centrifugal forces acting on the pistons, as a result of which the pistons can run with essentially lower friction. Furthermore, the housing of the oscillating piston machine according to the invention is of spherical construction, in contrast to the known oscillating piston machine mentioned at the beginning, which has the advantage that the overall arrangement of the pistons in conjunction with their central bearing in the housing can be constructed with a very particularly homogenous distribution of mass. Furthermore, the spherical configuration of the oscillating piston machine according to the invention provides the advantage of the maximum working volume with significantly more compact overall dimensions of the oscillating piston machine. The individual working chambers can thus be configured with large volumes together with minimum overall dimensions of the oscillating piston machine. Yet a further advantage of the spherical embodiment is that there is a largely free choice with respect to the position of the common oscillating axis in relation to the axis of rotation.

In one preferred embodiment, the common oscillation axis of the pistons runs obliquely or perpendicularly with respect to the axis of rotation.

This measure has the advantage that the interaction between the reciprocating oscillation movements of the pistons and the rotating movement of the pistons can be implemented in a structurally simple and kinematically favorable way. While the oblique or perpendicular arrangement is preferred, it is, however, also conceivable to allow the common oscillation axis of the pistons and the common rotating axis to extend in parallel, for example to coincide.

However, all the embodiments have in common the fact that the angle between the oscillation axis and the axis of rotation is nonvariable while the oscillating piston machine is running. The advantage of a perpendicular arrangement of the oscillation axis with respect to the axis of rotation is that the reciprocating oscillating movements of the pistons do not act on the rotary movement about the axis of rotation as acceleration moments or deceleration moments, as a result of which very quiet running of the oscillation piston machine is achieved.

In a further preferred embodiment, the pistons are pivotably mounted on a spindle which forms the oscillation axis and which is connected, fixed in terms of rotation about the axis of rotation, to a shaft which forms the axis of rotation.

Here, the embodiment which is structurally particularly simple is advantageous. If the oscillation axis of the pistons intersects the axis or rotation essentially perpendicularly, as was mentioned before in a preferred embodiment, the spindle which forms the oscillation axis is arranged correspondingly perpendicularly with respect to the shaft which forms the axis of rotation, and said spindle is connected to said shaft fixed in terms of rotation about the axis of rotation.

In a further preferred embodiment, the shaft is made to lead out of the housing.

It is advantageous here that the shaft which forms the common axis of rotation can simultaneously serve as a drive axis or output axis. The rotary movement of the pistons in the housing can thus be converted directly into a rotary movement of the shaft without intermediate elements, it being then possible to tap this rotary movement outside the housing as drive energy.

In a further preferred embodiment, the shaft ends approximately centrally in the housing.

This embodiment has the advantage that only one bearing is required on the housing for the shaft, as a result of which the structural complexity of the oscillation piston machine according to the invention is reduced still further.

In a further preferred embodiment, in each case two pistons which lie essentially diametrically opposite one another with respect to the center of the housing are fixedly connected to one another to form a double piston.

In this embodiment, the two pistons of a double piston accordingly extend essentially radially starting from the oscillation axis in the opposite direction to the respective opposite inner wall of the housing. The advantage of this measure is that only half the number of bearing rings is required for two pistons, as a result of which, on the one hand, the space required for the bearings of the pistons about the oscillation axis is reduced, and in addition fewer parts are required for the bearings of the pistons.

In one particularly preferred embodiment, a total of four pistons are arranged in the housing, two double pistons then being arranged in the housing in conjunction with the previously mentioned preferred embodiment. These two double pistons crossing over at the common oscillation axis approximately in the form of an X.

In a further preferred embodiment, as the pistons rotate in the housing, they are guided along at least one control cam curve formed on the housing, in order to control the reciprocating oscillation movements.

The provision of the control cam curve has the advantage that the oscillating movements of the individual pistons are controlled precisely in a defined way. The provision of the at least one control cam on the housing differs from the known oscillating piston machine mentioned at the beginning in which a cam element which is fixed to the housing is arranged centrally in the housing. On the other hand, in the oscillating piston machine according to the invention, the pistons are mounted centrally in the housing about the common oscillation axis, and the control cam curve is formed on the housing, as a result of which the oscillating movements of the pistons can take place with a large stroke.

It is preferred here if the control cam is embodied as at least one groove which is provided in the housing and into which in each case at least one guide element which is assigned to the respective piston and fixed to the piston engages.

The provision of a groove in the wall of the housing has the advantage that the respective guide element which engages in the groove and is fixed to the piston is guided on two sides, specifically on the two opposite side walls of the groove.

In a further preferred embodiment, the guide element has at least one roller, or the guide element is embodied as a sliding bearing.

If the guide element has at least one roller, the advantage here is that the individual pistons are guided in the groove with very low friction, as a result of which energy losses during the rotation of the pistons in the housing are reduced.

It is particularly preferred if the guide element has two rollers, one of which is in contact with one side face of the groove and the other with the opposite side face of the groove.

This measure has the advantage that as the two individual rollers rotate in the groove they do not need to reverse their direction of rotation depending on whether they are in contact with one side face or the other side face of the groove. In the present embodiment, one roller is always in contact with one side face of the groove, resulting in this roller having the same direction of rotation viewed over one full rotation of the roller in the groove, while the other roller is always in contact with the opposite side face, and this roller therefore also does not experience any reversal of direction of rotation during the rotation in the groove.

In conjunction with one of the previously mentioned embodiments according to which in each case two pistons are combined to form one double piston, in a further preferred embodiment there is provision for each double piston to have only one guide element.

This is also an advantage of combining in each case two pistons to form one double piston because only one guide element is necessary per double piston and as a result it is even the case that only one control cam curve overall is necessary for two double pistons, as a result of which the structural expenditure is reduced even further.

As an alternative to the embodiment of the control cam curve as a groove which is provided in the housing, the control cam curve can also preferably be embodied as at least one projection which projects inward from the housing and along which the pistons are guided.

The advantage of this measure is that the pistons can be guided directly with a face specific to the piston, on the inwardly projecting projection without providing a roller, as a result of which a structurally particularly simple embodiment of the oscillation piston machine is obtained.

In a further preferred embodiment, each piston has a working side and a rear side turned away from the latter, a respective working chamber being formed between two working sides, which respectively face one another, and the housing, while in each case a secondary chamber which increases or decreases in volume in inverse proportion to the working chambers is formed between two respective rear sides of two adjacent pistons and the housing.

The advantage of this measure is that the secondary chambers which are formed in each case between two rear sides of two adjacent pistons and which, during the reciprocating oscillating movements of the individual pistons, behave, in terms of their volume, in inverse proportion to the working chambers in which the working strokes of the intake, compression, expansion and expulsion take place, can be used for various purposes, specifically, on the one hand for cooling the pistons or as pressure chambers, as is provided in further preferred embodiments which will be described below.

In a further preferred embodiment, the pistons are embodied in such a way that the working chamber which is formed in each case by two adjacent pistons is a spherical-wedge-shaped construction and that its width can be varied in the plane perpendicular to the oscillation axis of the pistons.

This embodiment of the pistons gives rise to a working volume which is enlarged in comparison with the known oscillating piston machine mentioned at the beginning, which can lead to an increased power output when the oscillating piston machine according to the invention is used as an internal combustion engine.

In a further preferred embodiment, the aforementioned at least one secondary chamber can be flooded with a fluid, preferably air.

If the oscillating piston machine according to the invention is used as an internal combustion engine, this measure can advantageously allow fresh air to be directed into the secondary chambers in order to cool the rear sides of the pistons, the inner wall of the housing as well as the central piston bearings. This advantageously results in an increase in the overall efficiency in comparison with other internal combustion engines of a known type. In the simplest case, the secondary chambers can also simply serve as an oil space or oil/air space for cooling and lubrication.

In a further structurally simple embodiment of the previously mentioned measure, at least one inlet valve is present on the housing in order to flood the at least one secondary chamber.

By virtue of the fact that the at least one secondary chamber also increases and decreases in volume as a result of the reciprocating oscillating movement, this inlet valve can be embodied as a simple flap valve or butterfly valve because the continuous, alternating change in volume results alternately in a partial vacuum and an overpressure by means of which the inlet valve is automatically controlled. In this way, complex valve control means, for example a camshaft or even complex valves, for example solenoid valves, can be dispensed with.

In a further preferred embodiment, the fluid in the secondary chamber is compressed by means of the oscillating movement of the assigned pistons.

This measure has the advantage that, in a structurally particularly simple way, the at least one secondary chamber serves not only to cool the pistons, the housing and the piston bearings but also simultaneously as a pressure chamber which, when the oscillating piston machine according to the invention is used as an internal combustion engine, can serve to precompress the combustion air which was previously sucked into the at least one secondary chamber. In this sense, the aforementioned fluid is preferably fresh air.

A case particularly preferred in this context is if the at least one secondary chamber communicates with the at least one working chamber via at least one inlet valve which permits the compressed fluid to pass from the at least one secondary chamber into the working chamber.

This embodiment provides the considerable advantage that the oscillating piston machine according to the invention can be used as a self-supercharging internal combustion engine. In other words, with the oscillating piston machine according to the invention such a self-supercharging effect is integrated into the machine. This self-supercharging effect is made possible by the secondary chambers which increase and decrease in size in inverse proportion to the working chambers. The fluid which is precompressed in the at least one secondary chamber, for example precompressed combustion air, can then pass in compressed form into the at least one working chamber, for example if the latter is actually located in the intake cycle or at the end thereof. In other words, the combustion air can already be charged into the at least one working chamber with an admission pressure so that in this way it is possible to achieve compression rates which are sufficient to operate the oscillating piston machine according to the invention as a diesel engine. The self-supercharging effect can be brought about within the scope of this preferred embodiment without attaching a supercharging air compressor, making self-supercharging of the oscillating piston machine according to the invention possible with a minimum degree of structural expenditure.

In one further embodiment, the at least one secondary chamber communicates with the at least one working chamber via a line which is arranged on the outside of the housing, the at least one inlet valve through which fluid passes into the working chamber from the secondary chamber being arranged on the housing.

In an alternative preferred embodiment, the at least one secondary chamber communicates with the at least one working chamber through the intermediate piston, the inlet valve through which the fluid passes into the working chamber from the secondary chamber being arranged on the piston.

While the first embodiment has the advantage that the piston can be fabricated in a structurally simple way because there is no need to integrate valves into the pistons but rather only one additional inlet valve has to be provided on the housing, the second embodiment has the advantage that it is in turn possible to use simple flap valves or butterfly valves as the inlet valve, and the function of these valves is independent of the ambient pressure of the housing. On the other hand, in the first embodiment, a controlled valve is preferably used in the form of a solenoid valve, or in the simple case a valve controlled via a camshaft.

In the oscillating piston machine according to the invention, in order to obtain large-volume working chambers the pistons are preferably arranged in such a way that in each case two adjacent pistons alternately approach one another and move away from one another owing to the oscillating movements.

Further advantages and features emerge from the following description and the appended drawing.

It goes without saying that the features which are mentioned above and those which are to be explained below can be used not only in the respectively specified combination but also in other combinations or in isolation without departing from the scope of the present invention.

BRIEF DESCRIPTION OF THE DRAWINGS

Exemplary embodiments of the invention are illustrated in the drawing and will be described in more detail below with reference thereto. In said drawing.

DETAILED DESCRIPTION OF THE PREFERRED EMBODIMENTS

Figure 1:
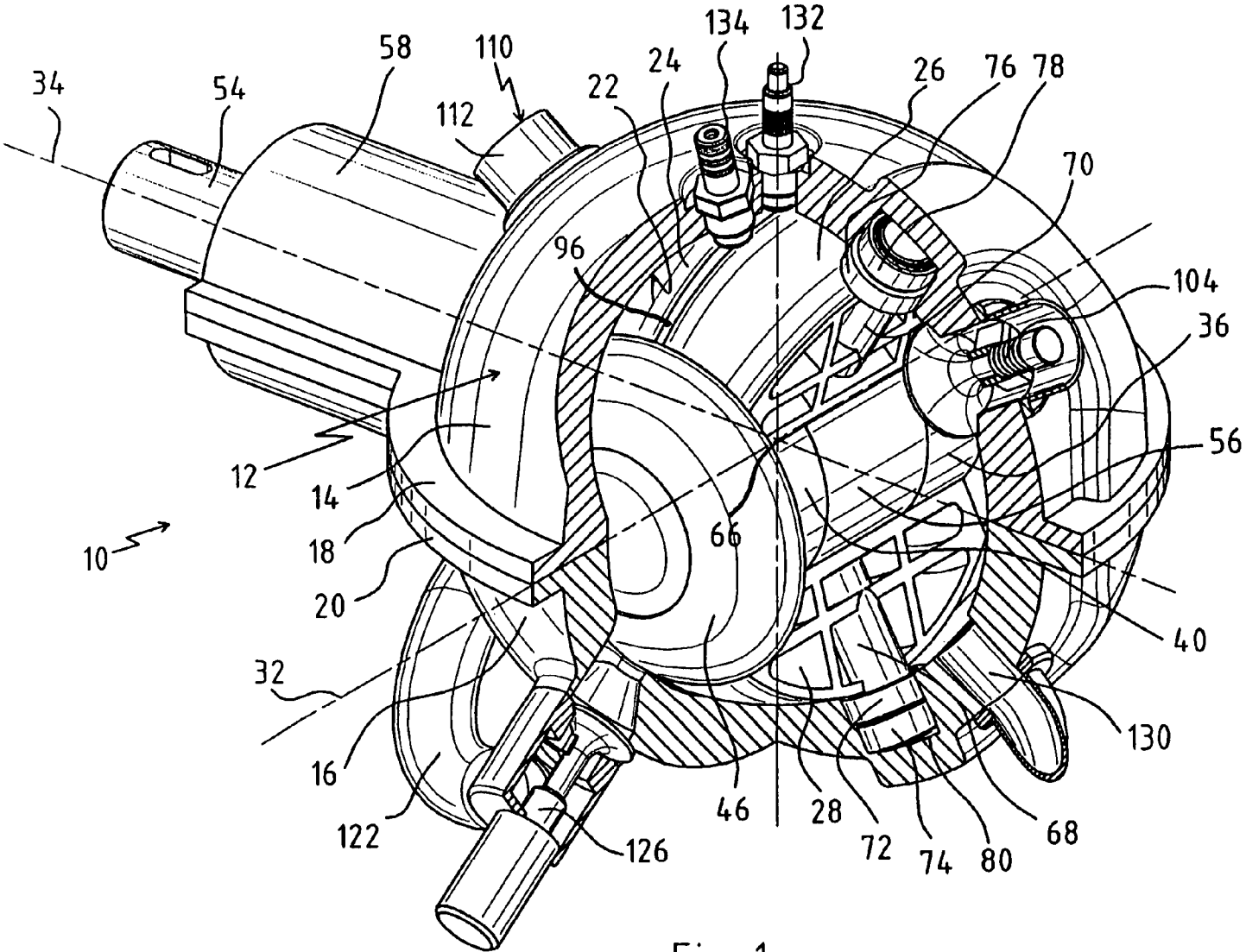
FIG. 1 shows a partially cut away, perspective overall view of an oscillating piston machine according to the invention in accordance with a first exemplary embodiment and in a first operating position of the piston.
Figure 2:
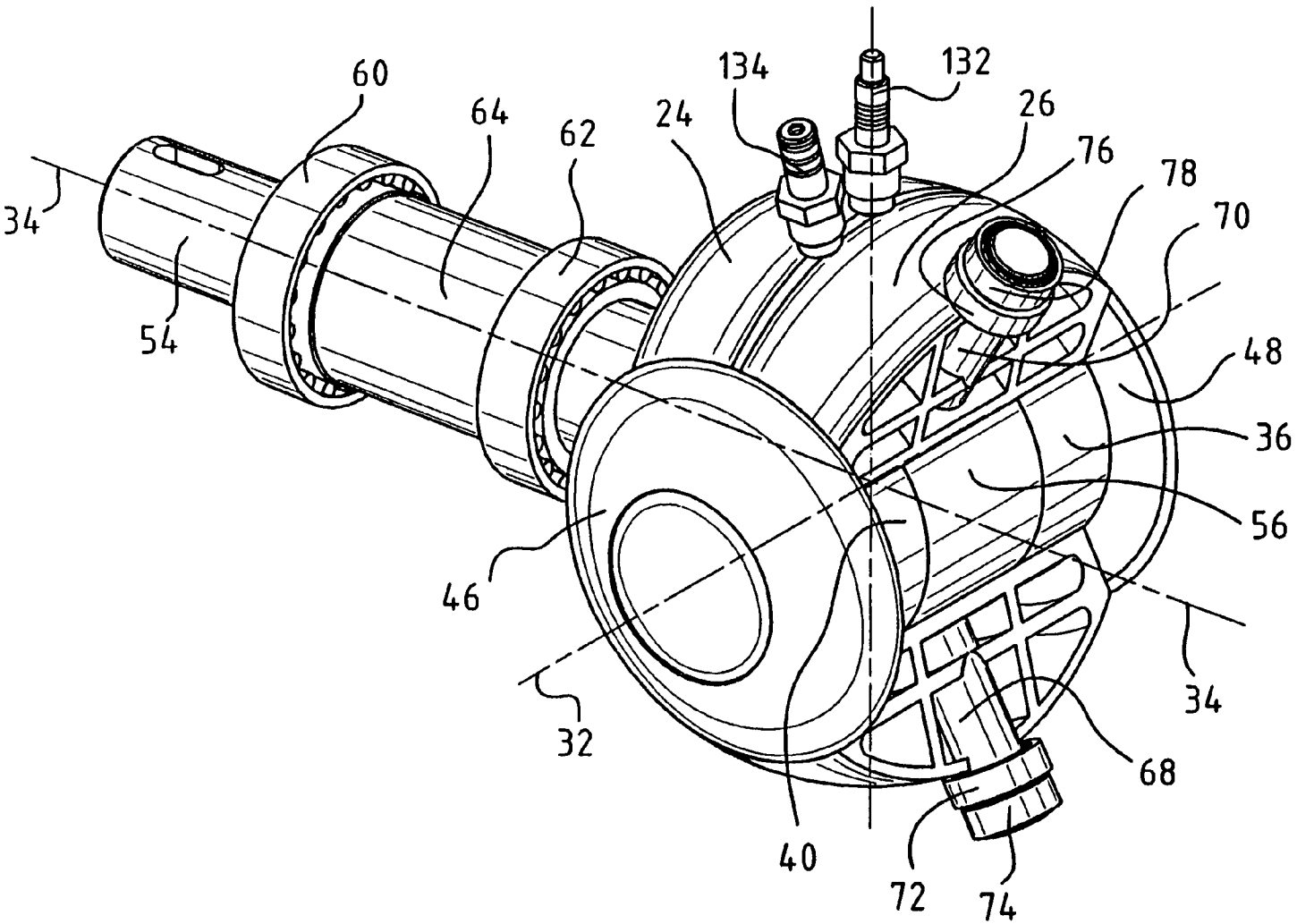
FIG. 2 shows a perspective view of the oscillating piston machine in FIG. 1 without a housing.
Figure 3:
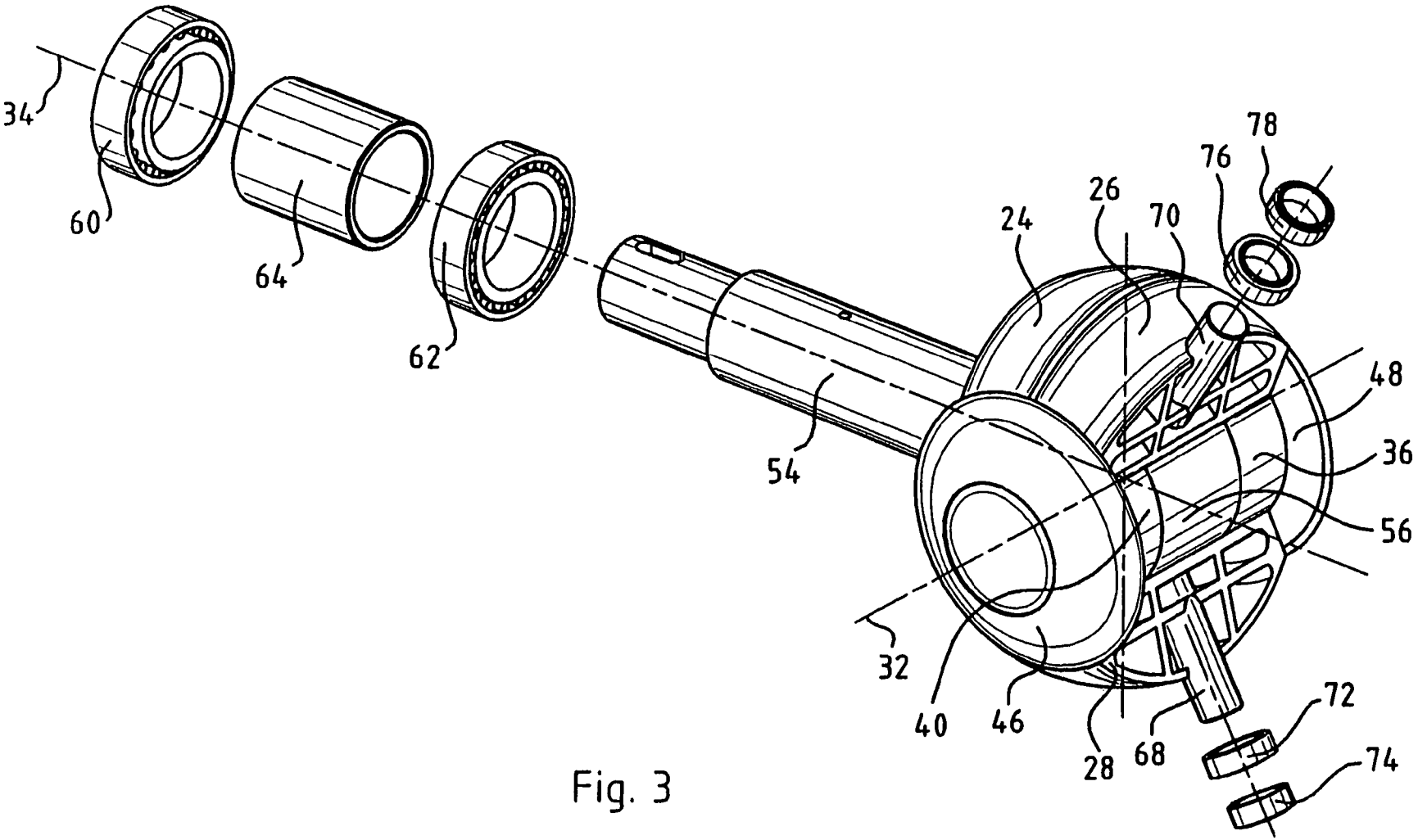
FIG. 3 shows a perspective exploded view of the components of the oscillating piston machine in FIG. 1 which are illustrated in FIG. 2.

The embodiment of an oscillating piston machine which is provided with the general reference number 10 will be described in more detail below with reference to FIGS. 1 to 8. The oscillating piston machine 10 serves as an internal combustion engine but can also be used in other applications, for example as a compressor.

The oscillating piston machine 10 has a housing which is provided with the general reference number 12 and is composed of a first housing half 14 and a second housing half 16.

The two housing halves 14 and 16 are permanently connected to one another via a respective annular flange 18 or 20.

An inner wall 22 of the housing 12 is of spherical construction. On the outside the housing 12 of the oscillating piston machine 10 also has spherical symmetry.

In FIG. 1, the housing 12 is illustrated partially cut away so that in FIG. 1 further details of the oscillating piston machine 10 can be seen inside the housing 12.

Figure 4:
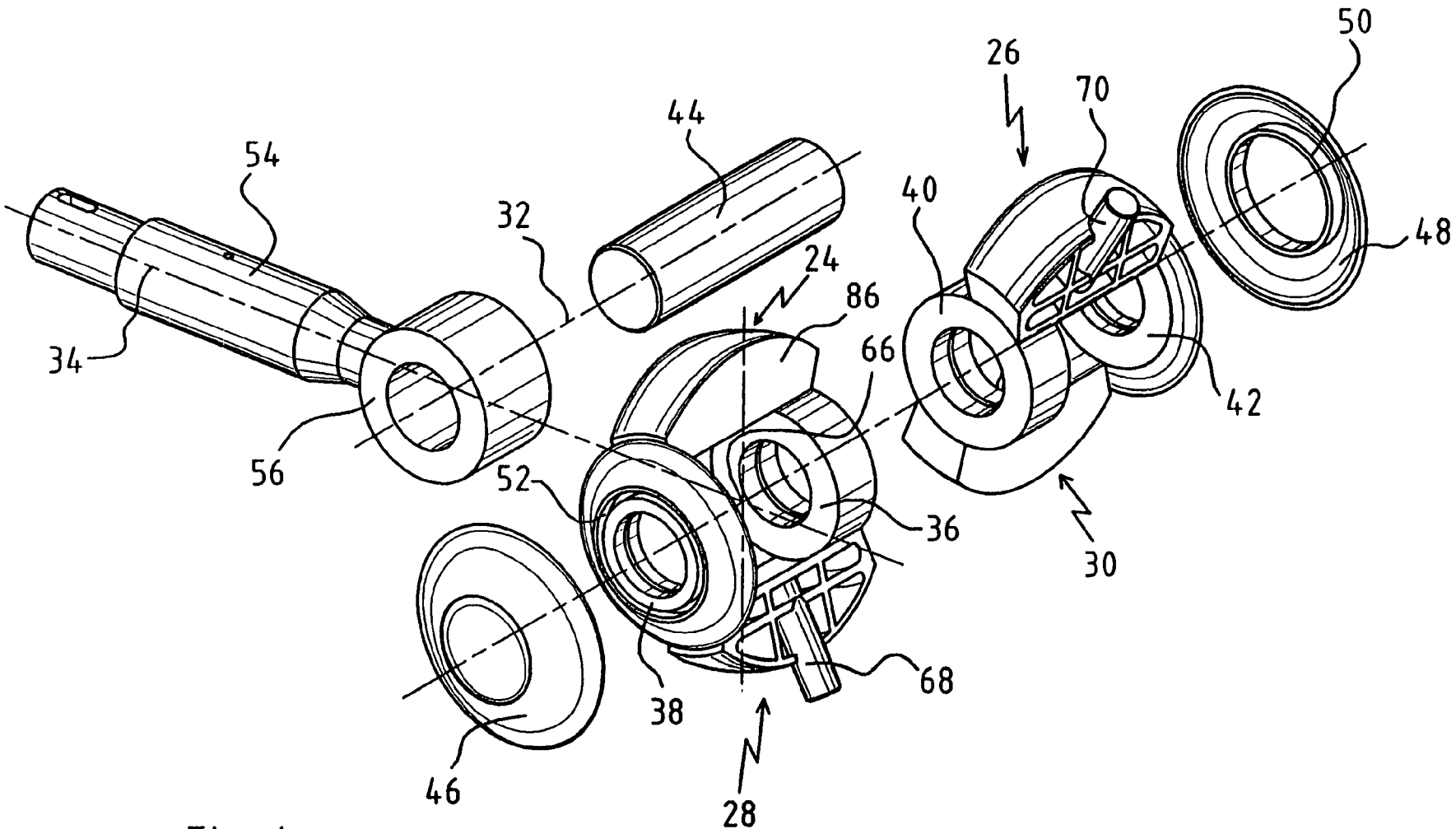
FIG. 4 shows a further perspective exploded view of the components of the oscillating piston machine in FIG. 3, with further components being omitted.
Figure 5:
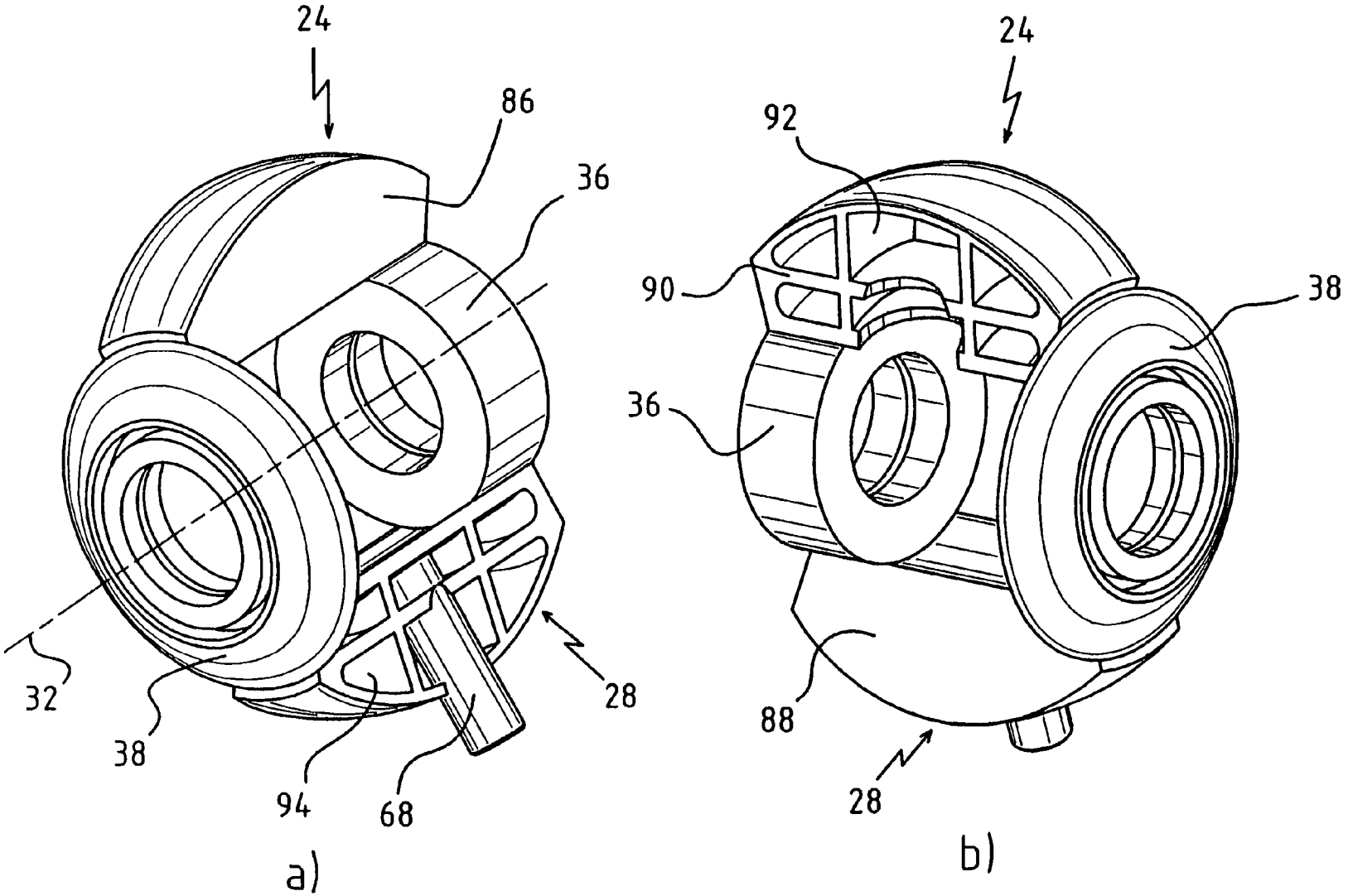
FIGS. 5*a*) and 5*b*) show a double piston of the oscillating piston machine in FIG. 1 in a perspective view, the view in FIG. 5*b*) being rotated through 90° with respect to the view in FIG. 5*a*)
Figure 7:
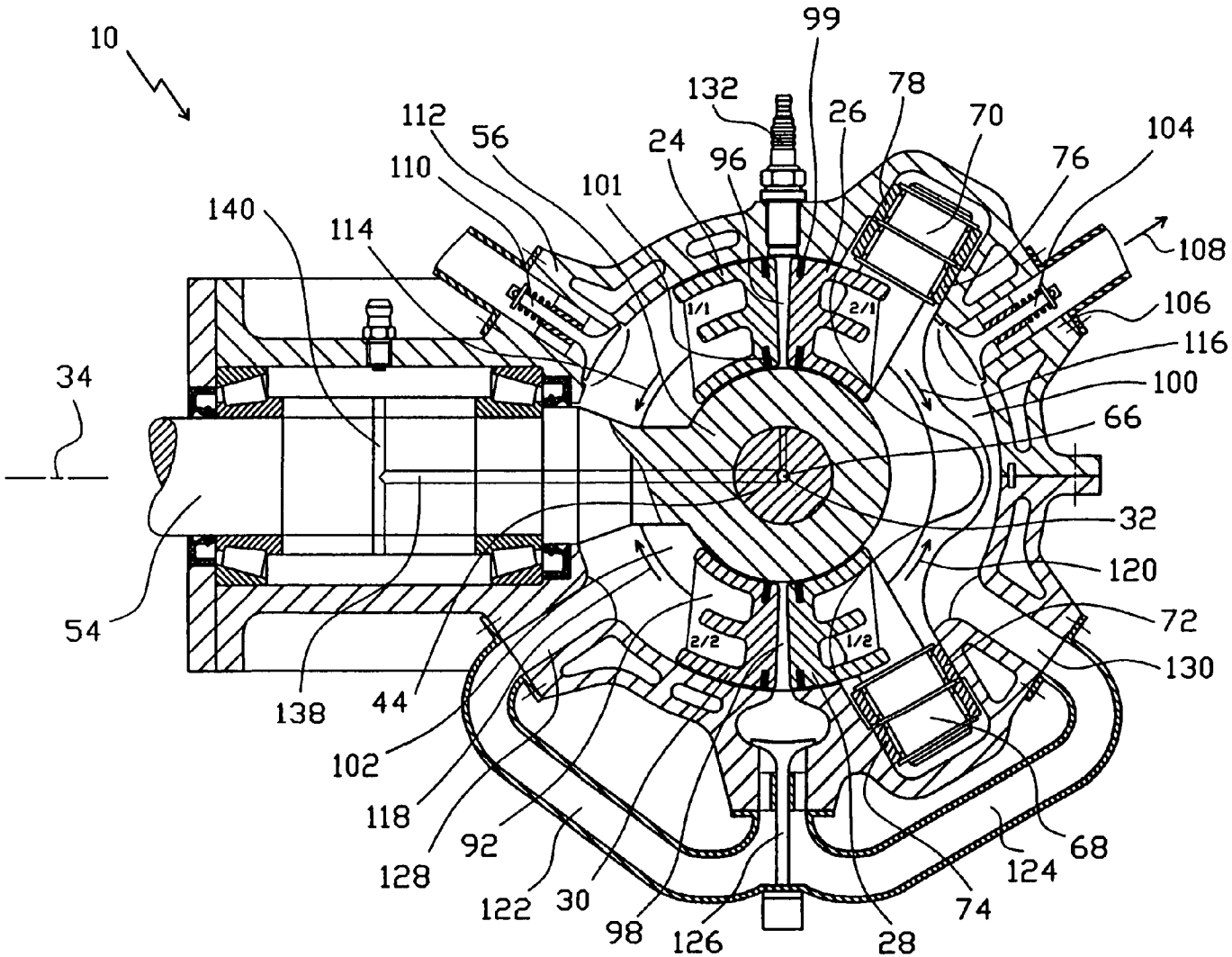
FIG. 7 shows a section through the oscillating piston machine in FIG. 1 along a plane which is parallel to the axis of rotation of the pistons and perpendicular to the oscillation axis of the pistons.

A plurality of pistons, and in the present exemplary embodiment four pistons 24, 26, 28 and 30, are arranged in the housing 12, the piston 30 being concealed in FIG. 1 and being shown, for example, in the perspective exploded view in FIG. 4 and in FIG. 7.

In each case two pistons are fixedly connected to one another to form a double piston, specifically the pistons 26 and 30 are fixedly connected to one another to form a double piston, and likewise the pistons 24 and 28 form a one-piece rigid double piston.

The pistons 24 to 30 can oscillate about a common oscillation axis 32, and at the same time the pistons 24 to 30 rotate about a common axis 34 of rotation in the housing 12, the reciprocating oscillating movements being superimposed on the rotary movement, as will be explained in more detail below.

In order to provide oscillating bearings, the double piston formed from the pistons 24 and 28 has a bearing ring 36, permanently connected to the two pistons 24 and 28, at one end of the pistons 24 and 28, and a second bearing ring 38 at the opposite end of the pistons 24 and 28. The double piston which is formed from the pistons 26 and 30 is identical to the double piston formed from the pistons 24 and 28 and correspondingly has a first bearing ring 40 and a second bearing ring 42.

The first double piston which is formed from the pistons 24 and 28 and the second double piston which is formed from the pistons 26 and 30 are pivotably mounted on a spindle 44 by means of the bearing rings 36 and 38, and 40 and 42, respectively, said spindle 44 forming the oscillation axis 32. The first double piston which is formed from the pistons 24 and 28 and the second double piston which is formed from the pistons 26 and 30 are arranged rotated through 180° with respect to one another on the spindle 44 here, the first double piston which is formed from the pistons 24 and 28 and the second double piston which is formed from the pistons 26 and 30 extending in crosswise fashion on the spindle 44, and the oscillation axis 32, respectively. As will be explained in more detail below, the oscillating movement between the individual pistons 24 to 30 is carried out in each case in opposite directions in pairs.

The arrangement composed of the pistons 24 to 30 and the spindle 44 is tightly sealed at the ends of the spindle 44 by means of closure caps 46 and 48. The closure caps 46 and 48 each have, for this purpose, an inwardly protruding annular flange 50 which engages in a sealing fashion in a respective groove 52 on the second bearing rings 38 and 42. The closure caps 46 and 48 form, on the outside, a spherical-cap shaped termination of the arrangement of the pistons 24 and 30 at the two ends of the spindle 44 which is adapted to the radii of curvature of the inner wall 22 of the housing 12.

The spindle 44 is connected to a shaft 54 by nonreleasibly pressing the spindle 44 into a drilled hole in a ring 56 at one end of the shaft 54 so that at both ends the spindle 44 projects to an equal extent out of the ring 56 on both of its sides. The pistons 24 to 30 are mounted with the bearing rings 36 to 42 on the regions of the spindle 44 which project out of the ring 56 on both sides. The ring 56 is permanently connected to the shaft 54. The spindle 44, and thus the oscillation axis 32, extends perpendicularly to the axis 34 of rotation which is formed by the shaft 54. With respect to the axis 34 of rotation, the spindle 44 is connected fixed in terms of rotation to the shaft 54 but the spindle 44 is also nonrotatably secured in the ring 56 of the shaft 54 with respect to the oscillation axis 32.

According to FIG. 1, the shaft 54 is made to lead out of the housing 12 and serves as an output shaft for the oscillating piston machine 10.

A tubular projection 58 through which the shaft 54 is made to lead out of the housing 12 is correspondingly formed on the housing 12. The shaft 54 is mounted, according to FIGS. 2 and 3, in the projection 58 by means of running bearings 60 and 62 with an intermediate sleeve 64.

As is apparent from FIGS. 1 to 8, in particular from FIG. 7, the shaft 54 ends inside the housing 12, centrally in the housing.

The spindle 44, and thus the oscillation axis 32, run through the center of the housing, which is designated by the reference number 66 in FIG. 7. The pistons 24 to 30 are accordingly pivotably mounted on an oscillation axis 32 which is central in the housing. The axis 34 of rotation also runs through to the center of the housing and intersects the oscillation axis 32 perpendicularly there.

The already aforementioned first double piston is formed from the pistons 24 and 28 which are essentially diametrically opposite with respect to the oscillation axis 32 or the center 66 of the housing, and the second double piston is formed from the pistons 26 and 30 which are essentially diametrically opposite with respect to the oscillation axis 32 or the center 66 of the housing.

The first double piston which is formed from the pistons 24 and 28 is also provided with a guide element 68 which is fixed to the pistons, and the double piston which is formed from the pistons 26 and 30 is likewise provided with a guide element 70. The guide elements 68 and 70 serve to control the reciprocating oscillating movements of the pistons 24 to 30 about the oscillation axis 32 when the pistons 24 to 30 rotate about the axis 34 of rotation. The guide elements 68 and 70 are embodied as a type of axial rods. Two rollers 72 and 74 are arranged at the ends of the guide element 68 of the pistons 24 and 28. The roller 72 has a larger external diameter than the roller 74. Correspondingly, rollers 76 and 78 are arranged at the ends of the guide element 70, the roller 76 having a larger external diameter than the roller 78.

The guide elements 68, 70 engage via the rollers 72, 74 and 76, 78, respectively, in a control cam curve which is provided as a groove 80 in the inner wall 22 of the housing 12, in order to control the reciprocating oscillating movements of the pistons 24 to 30. The control cam curve which is embodied as a groove 80 is centered here on the housing about the axis 34 of rotation, as a prolongation of the shaft 54, i.e. arranged opposite the ring 56 of the shaft 54. The control cam curve which is formed by the groove 80 is a closed cam without points of intersection and is approximately in the shape of a circle which is constricted on diametrically opposite sides.

Figure 12:
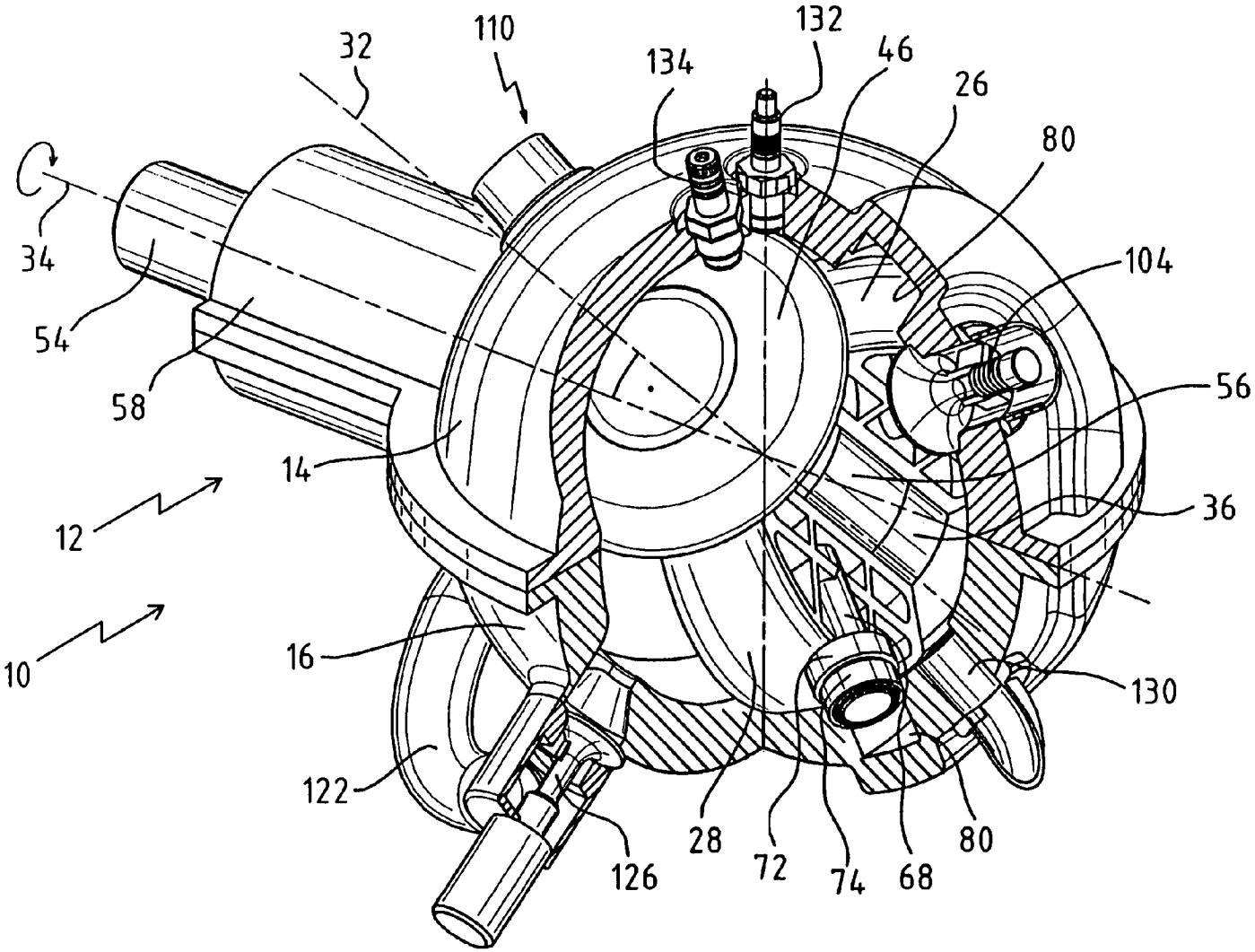
FIGS. 12 to 14 show perspective views of the oscillating piston machine in FIG. 1 in various operating positions of the pistons corresponding to FIGS. 9 and 10.
Figure 13:
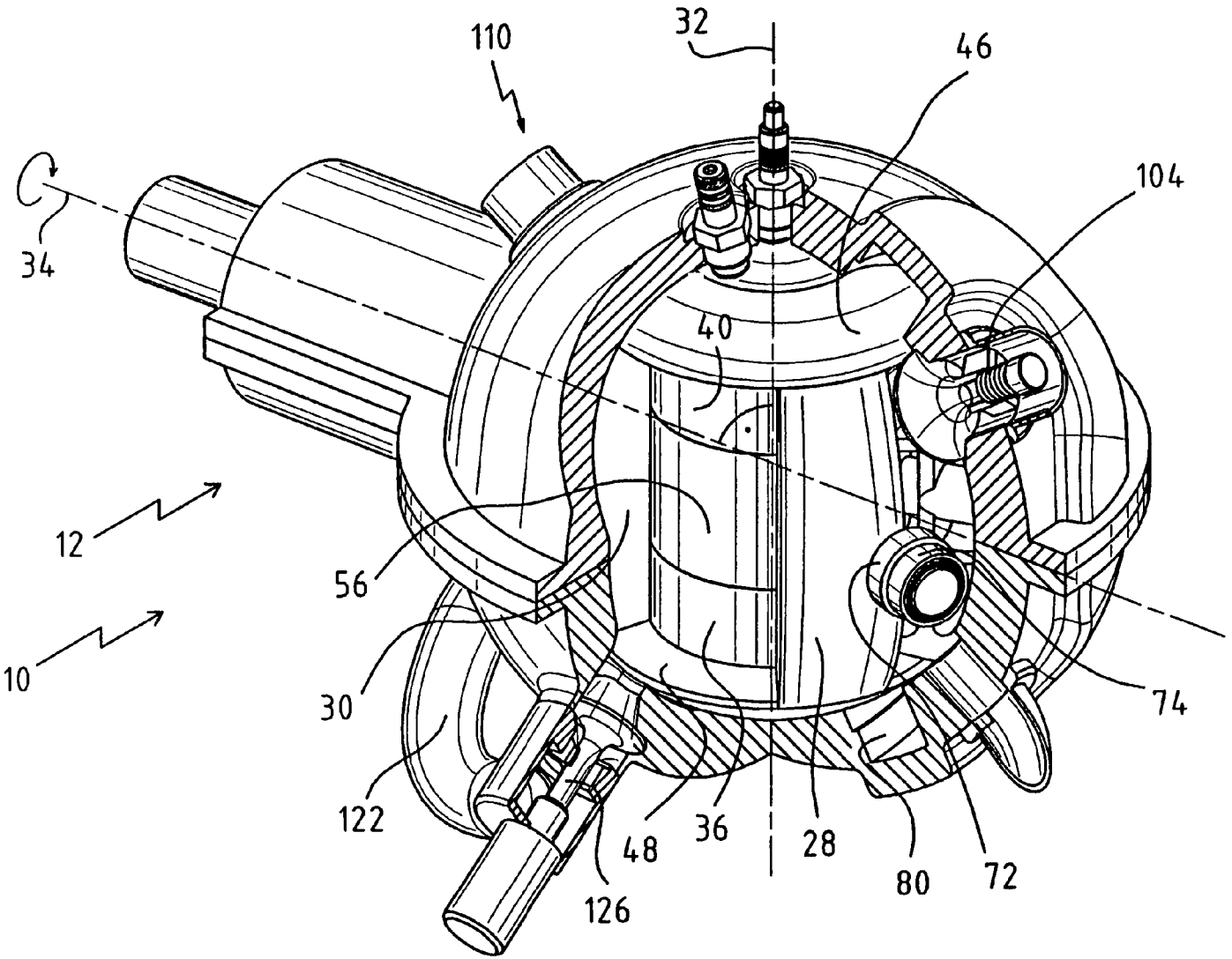
Figure 14:
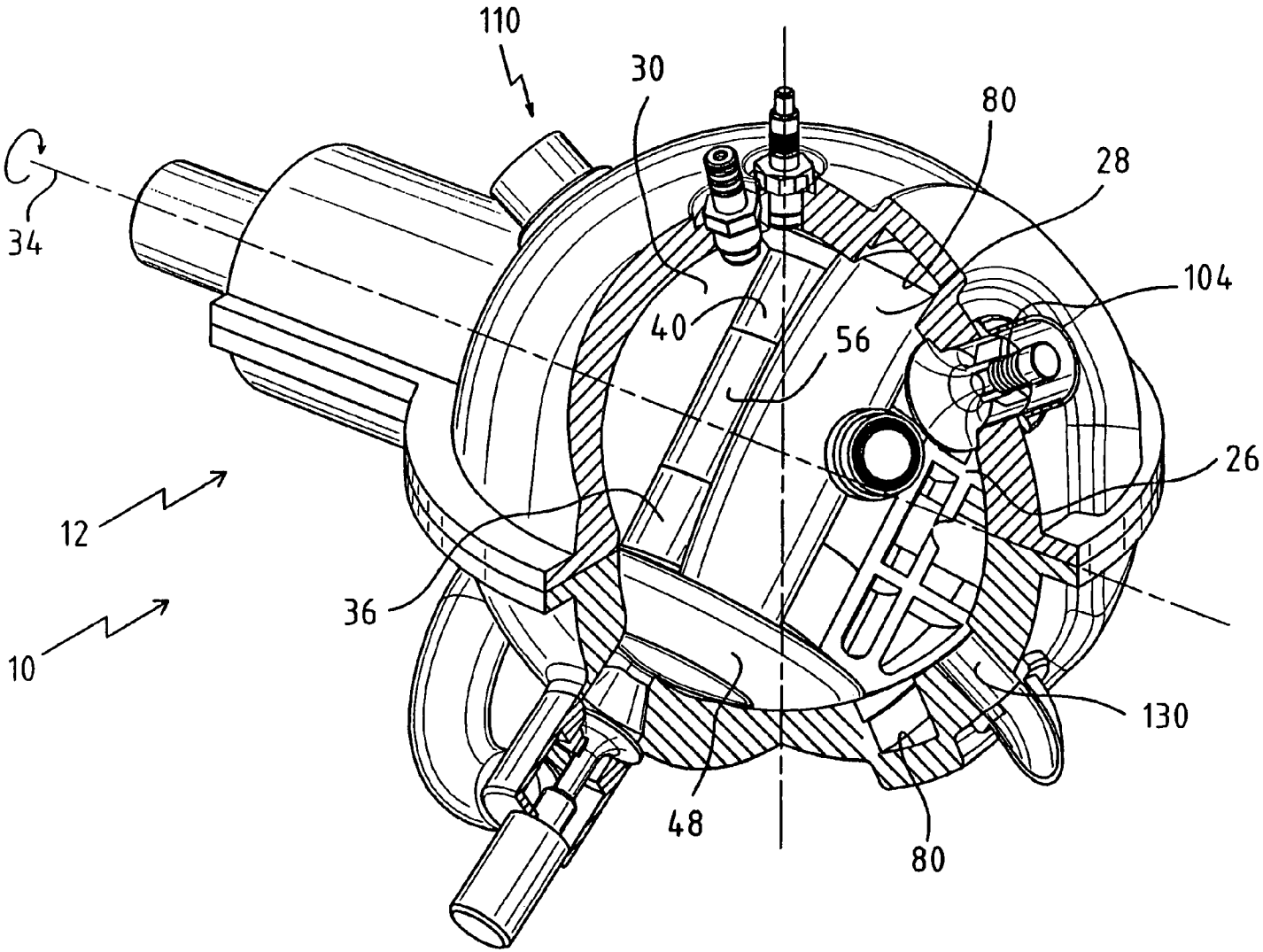

The groove 80 has a shape which is stepped in the radial direction in accordance with the different external diameters of the roller 72 and of the roller 74 and in accordance with the difference between the external diameter of the roller 76 and of the roller 78, that is to say the side faces 82 and 84 of the groove 80 have a step (cf. FIGS. 12 to 14). The arrangement is made here in such a way that the rollers 72 and 76 with a relatively large external diameter rest only on one side face 84 during the rotation in the groove 80, while the rollers 74 and 78 with a relatively small external diameter rest on the opposite side face 82 so that the respective direction of rotation of the rollers 72 to 78 is the same over one complete rotation through the groove 80.

As is apparent in particular from FIG. 1, the guide elements 68 and 70 engage in the groove 80 with an offset of 180° with respect to one another. This wraparound angle condition of 180° being maintained over one complete rotation of the pistons 24 to 30 in the housing 12 about the axis 34 of rotation. The shape of the groove 80 is particularly clear from the illustration in FIGS. 6*a*) and 6*b*), which show a section through the housing 12 along a plane perpendicular to the axis 34 of rotation and parallel to the oscillation axis 32, FIG. 6*a*) showing the outside of the housing 12 and FIG. 6*b*) showing the inside of the housing 12.

The double piston formed from the pistons 24 and 28 is shown in isolation in FIGS. 5*a*) and 5*b*). Each of the pistons 24 to 30 has, as is illustrated in the example of the pistons 24 and 28 in FIGS. 5*a*) and 5*b*), a working side and a rear side opposite it.

For the piston 24, a working side is designated by the reference number 86. The working side 86 is essentially flat and planar and extends with its largest dimension in parallel with the oscillation axis 32. A corresponding, identical working side of the piston 28 is provided with the reference number 88.

A rear side 90 of the piston 24 which is opposite the working side 86 of the piston 24 is provided with a multiplicity of cavities 92 which are open toward the rear side 90 but which are closed on the working side 86. In the same way, a rear side 94 which lies opposite the working side 88 of the piston 28 is formed on the piston 28.

The identical pistons 26 and 30 have the same embodiment as that of the pistons 24 and 28 which was described above.

Between the working sides of respectively adjacent pistons 24 to 30 a working chamber is formed. Owing to the embodiment of the oscillating piston machine 10 with four pistons 24 to 30, there are therefore two working chambers 96 and 98, the working chamber 96 being formed between the working sides of the adjacent pistons 24 and 26, and the working chamber 98 being formed between the working sides of the adjacent pistons 28 and 30. As the pistons 24 to 30 rotate in the housing 12, the working chambers 96 and 98 change their volume, owing to the reciprocating oscillating movements, between a virtually closed position (illustrated in FIG. 7) with a small volume, and a maximum volume which is illustrated, for example in FIG. 17, in an oscillating piston machine 10' which operates identically in this respect. Owing to the reciprocating oscillating movement, in each case two adjacent pistons 24 to 30 alternately approach one another or move away from one another.

The working chambers 96 and 98 are approximately in the shape of spherical wedges whose width is variable in the plane perpendicular to the oscillation axis 32, i.e. in the plane in FIG. 7, in accordance with the reciprocating oscillating movements of the pistons 24 to 30. The working chambers 96 and 98 are bounded by the working sides of the pistons 24 to 30, the inner wall of the housing 12 and, toward the center 66 of the housing, by the bearing rings 36 to 42, and the ring 56 of the shaft 54.

In addition, the working chambers 96 and 98 are sealed off from the inner wall 22 of the housing 12 by means of seals 99, and from the ring 56 of the shaft 54 by means of seals 101. It is not necessary to seal the pistons 24 to 30 with respect to the bearing rings 36 to 42 owing to the integral connection thereof to the pistons 24 to 30.

Secondary chambers are formed between the rear sides of the respectively adjacent pistons 24 to 30. In accordance with the embodiment of the oscillating piston machine 10 with a total of four pistons 24 to 30 there are two secondary chambers, specifically one secondary chamber 100 between the piston 26 and the piston 28, and one secondary chamber 102 between the piston 30 and the piston 24. Viewed in the circumferential direction with respect to the oscillation axis 32, both working chambers 96 and 98 are adjacent to the secondary chamber 100 and 102, respectively.

Owing to the cavities 92 on the rear sides of the pistons 24 to 30, the maximum possible volume is utilized for the secondary chambers 100 and 102. The secondary chambers 100 and 102 increase and respectively decrease their volume in inverse proportion to the working chambers 96 and 98. The volumes of the working chambers 96 and 98 increase and decrease together as the pistons 24 to 30 rotate in the housing 12 about the axis 34 of rotation, and the secondary chambers 100 and 102 also decrease or increase together.

The secondary chambers 100 and 102 can be flooded with a fluid, preferably air.

For this purpose, an inlet valve 104 which is assigned to the secondary chamber 100 is present on the housing 12, in a valve housing 106 which is formed on the housing 12. The inlet valve 104 is a butterfly valve which is prestressed in the direction of an arrow 108. The inlet valve 104 is controlled by the different pressure conditions between the secondary chamber 100 and the space outside the housing 12. Accordingly, a further inlet valve 110, which is also arranged on the housing 12 in a valve housing 112 which is formed therein, is assigned to the secondary chamber 102. The inlet valve 110 is also a butterfly valve, and its method of operation corresponds to that of the inlet valve 104.

Figure 6:
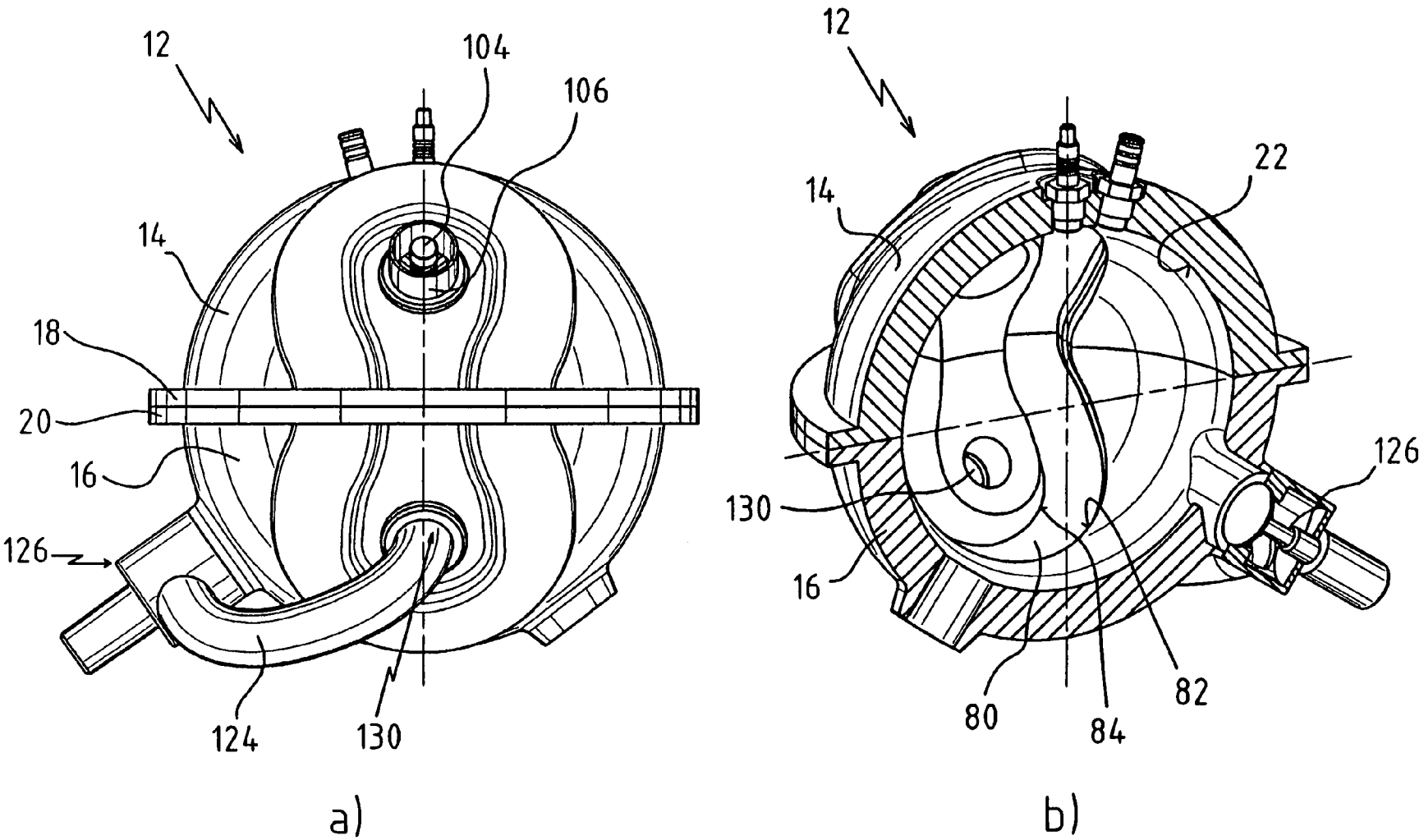
FIGS. 6*a*) and 6*b*) show perspective views of half cut-away views of the housing of the oscillating piston machine in FIG. 1 in isolation, FIG. 6*a*) showing the outside of the housing and FIG. 6*b*) showing the inside of the housing.

According to FIG. 6, the inlet valve 104 is located in a housing region inside the groove 80.

The fluid, preferably fresh air, which is introduced into the secondary chambers 100 and 102, respectively, through the inlet valves 104 and 110, respectively, serves initially to cool the pistons 24 to 30, in particular their bearing rings 38 to 42 as well as the spindle 44 and the inner wall 22 of the housing 12, and in addition to cool the rollers 72 to 78 on the guide elements 68 and 70 of the pistons 24 to 30.

In the exemplary embodiment shown, the secondary chambers 100 and 102 not only have the function of cooling but also serve to compress the fluid, i.e. the fresh air, introduced into the secondary chambers 100 and 102.

This compression occurs starting from the position of the pistons 24 to 30 illustrated in FIG. 7, by virtue of the fact that the pistons 24 and 26 oscillate in accordance with arrows 114 and 116, and the pistons 28 and 30 oscillate in accordance with arrows 118 and 120, as a result of which the volume of the secondary chambers 100 and 102 is decreased. Owing to the pressure which continuously increases in the process in the secondary chambers 100 and 102, the inlet valves 104 and 110 are pressed into their closed position (arrow 108 in FIG. 7) so that the fluid cannot escape from the secondary chambers 100 and 102, respectively, through the inlet valves 104 and 110, respectively.

The secondary chambers 100 and 102 also communicate with the working chambers 96 and 98 via, in each case, one line 122 and 124 which is arranged on the outside of the housing, and via an inlet valve 126 which is a controlled valve, for example a solenoid valve.

The line 122 is connected at one end to the secondary chamber 102 via an opening 128 in the housing 12, while the line 124 is connected to the secondary chamber 100 via an opening 130 in the housing 12. The lines 122 and 124 come together in the region of the inlet valve 126.

Depending on which of the working chambers 96 or 98 is opposite the inlet valve 126 at a particular time, the fluid which is compressed in the secondary chambers 100 and 102 can then be introduced into the corresponding working chamber 96 or 98, respectively. In this way, combustion air can be forced into the working chamber 96 or 98, respectively, with precompression, i.e. with an overpressure, as a result of which a self-supercharging effect of the oscillating piston machine 10 occurs.

Figure 8:
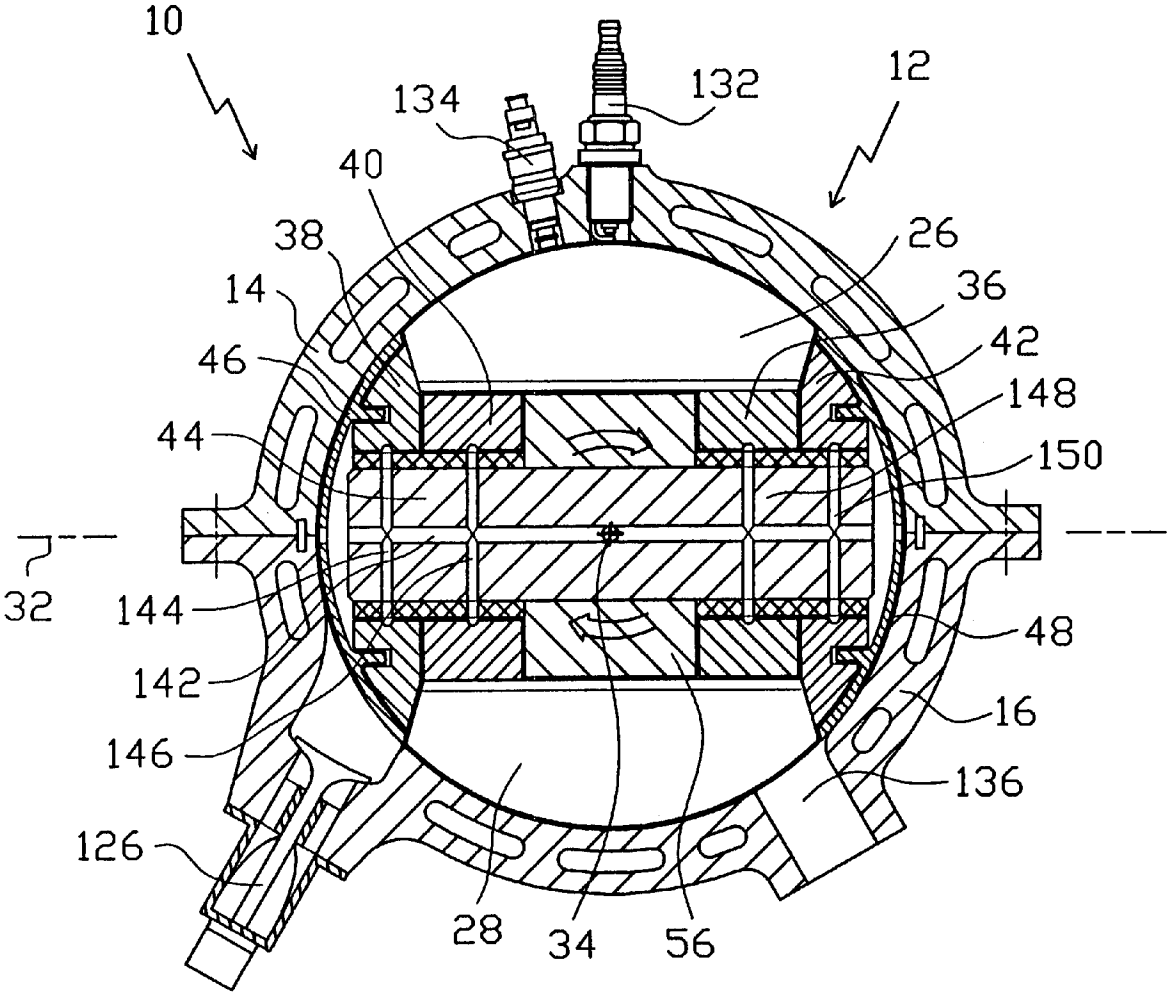
FIG. 8 shows a section through the oscillating piston machine in FIG. 1 along a plane which is parallel to the oscillation axis of the pistons and perpendicular to the axis of rotation.

The oscillating piston machine 10 also has a sparkplug 132 which is attached to the housing 12, an injection nozzle 134 which is directly adjacent to the sparkplug 132 and has the purpose of injecting fuel, and an outlet 136 which is shown only in FIG. 8 and has the purpose of expelling the burnt fuel/air mixture while the oscillating piston machine 10 is operating.

In addition, according to FIGS. 7 and 8, drilled holes 138 and 140 are present in the shaft 54, and drilled holes 142 to 150 in the spindle 54, these drilled holes serving to lubricate the moving parts with oil.

Figure 9:
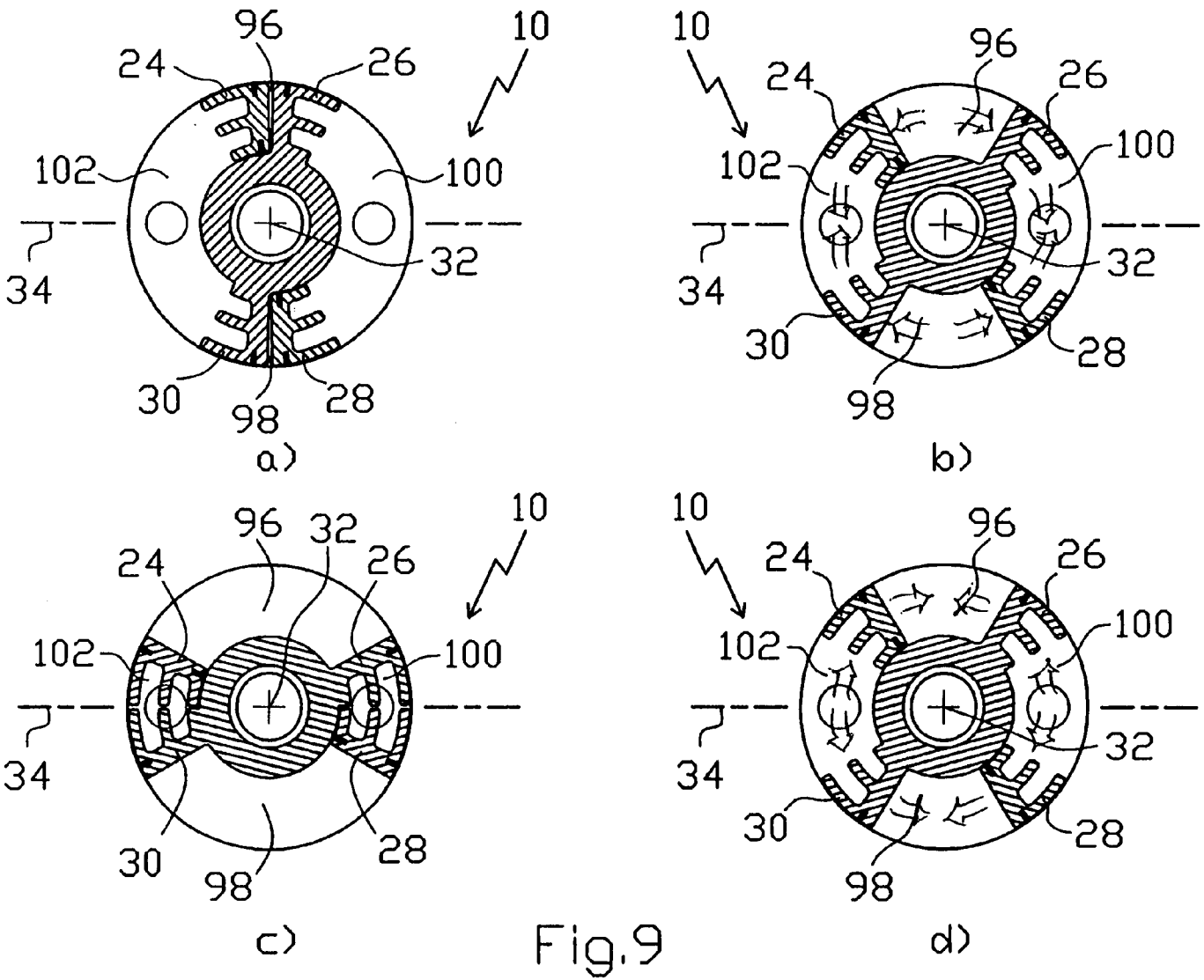
FIGS. 9*a*) to 9*d*) show schematic views of the functional principle of the oscillating piston machine in FIG. 1 in a section along the axis of rotation and transversely with respect to the oscillation axis of the pistons.
Figure 10:
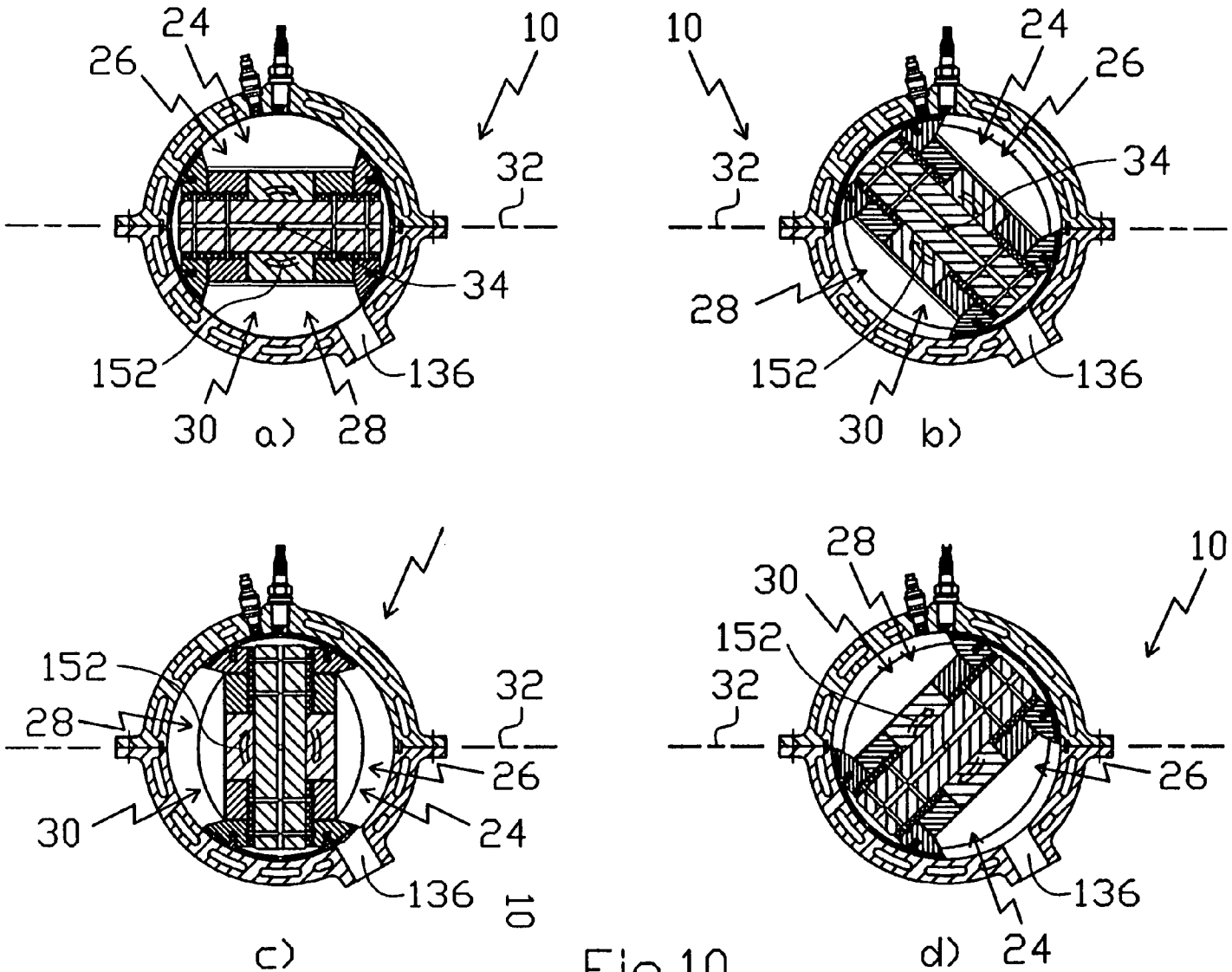
FIGS. 10*a*) to 10*d*) show schematic views of the functional principle of the oscillating piston machine in FIG. 1 in a section parallel to the oscillation axis and transversely with respect to the axis of oscillation of the pistons, the individual operating positions illustrated in FIGS. 10*a*) to 10*d*) corresponding to the operating positions illustrated in FIGS. 9*a*) to 9*d*)

The functional principle of the oscillating piston machine 10 will be described below in more detail with reference to FIGS. 9, 10 and 11, the individual movement sequences of the pistons 24 to 30 also being shown in the perspective views in FIGS. 1 and 12 to 14. The views in FIG. 9 are highly schematic.

In FIGS. 9*a*), 10*a*) and in FIG. 1 the pistons 24 and 26 are in what is referred to as the top dead center (OT), and the pistons 28 and 30 in the bottom dead center (UT). In this state, the working chamber 96 which is formed between the pistons 24 and 26 and the working chamber 98 which is formed between the pistons 28 and 30 have their minimum volume. The guide element 70 of the double piston which is formed from the pistons 26 and 30 is located in the groove 80 at its apex point (cf. position a) in FIG. 11), while the guide element 68 of the double piston which is formed from the pistons 24 and 28 is located at the opposite apex point of the groove 80 (position c) in FIG. 11).

In this state, compressed fuel/air mixture is present in the working chamber 96, while the chamber 98 is empty.

If the fuel/air mixture present in the working chamber 96 is then ignited by means of the sparkplug 132, the spontaneously occurring increase in pressure in the working chamber 96 attempts to pivot the pistons 24 and 26 apart about the oscillation axis 32. Owing to the piston 24 and the piston 26 being guided in the groove 80, this simultaneously brings about forced guidance of the pistons 24 and 26, and thus also of the pistons 28 and 30 which are permanently connected to the pistons 24 and 26, along the cam curve which is formed by the groove 80, as a result of which the pistons 24 to 30 are set in motion about the axis 34 of rotation in the direction of an arrow 152, i.e. the pistons 24 to 30 move about the axis 34 of rotation from the position illustrated in FIG. 10*a*) into the position illustrated in FIG. 10*b*), which is also illustrated in FIG. 12. At the same time as this rotational movement about the axis 34 of rotation, the pistons 24 and 26 pivot in opposite directions and likewise the pistons 28 and 30 pivot apart about the oscillation axis 32 in the opposite direction, as is apparent from the transition from FIG. 9*a*) to FIG. 9*b*). The pair of pistons which are formed by the pistons 24 and 26 is then in the expansion working stroke, while the pair of pistons which is formed by the pistons 28 and 30 is in the intake working stroke.

At the same time as the increase in volume of the working chambers 96 and 98, there is a reduction in volume of the secondary chambers 100 and 102. The air which has already entered the secondary chambers 100 and 102 through the inlet valves 104 and 110 is then compressed in the secondary chambers 100 and 102.

The working chambers 96 and 98 with their maximum volume are illustrated in FIG. 9*c*), the pistons 24 and 26 having terminated the expansion working stroke in this state, and the pistons 28 and 30 having terminated the intake working stroke. Up to this working position, the pistons 24 to 30 according to FIG. 10*c*) have moved on through 90° about the axis 34 of rotation from the starting position (cf. also FIG. 13). The guide elements 68 and 70 are then opposite one another at the apexes of the narrow side of the groove 80 (position b) and d) in FIG. 11). While the working chambers 96 and 98 assume their maximum volume in this state, the secondary chambers 100 and 102 have their minimum volume, i.e. the air present in the secondary chambers 100 and 102 is then compressed to a maximum extent. The inlet valve 126 is then preferably opened by appropriate actuation, as a result of which all of the compressed air present in the secondary chambers 100 and 102 is introduced into the working chamber 98.

Starting from this working position according to FIG. 9*c*), the pistons 24 and 26, and also the pistons 28 and 30, then approach one another again about the oscillation axis 32, as a result of which the pistons 24 and 26 then carry out the expulsion working stroke, and the pistons 28 and 30 carry out the compression working stroke of the combustion air which has been previously let in and is already precompressed. This working stroke is illustrated in FIG. 9*d*) and in FIG. 10*d*) and in FIG. 14, from which it is apparent that the pistons 24 to 30 have been moved on a further 45° about the axis 34 of rotation.

While the working chambers 96 and 98 decrease at the transition from the state illustrated in FIG. 9*c*) into the state illustrated in FIG. 9*d*), the secondary chambers 100 and 102 increase correspondingly. The increase in the secondary chambers 100 and 102 then brings about a situation in which a partial vacuum is established in the secondary chambers 100 and 102 with respect to the surroundings so that fresh air is sucked into the secondary chambers 100 and 102 through the inlet valves 104 and 110 which open automatically in the process.

Starting from the position illustrated in FIGS. 9*d*) and 10*d*) and 14, there is then a position in which the pistons 24 to 30 are rotated through 180° about the axis 34 of rotation with respect to the FIGS. 9*a*), 10*a*) and 11, but which cannot be visually distinguished, the pistons 24 and 26 now being in the bottom dead center and the pistons 28 and 30 in the top dead center. This means that fuel is then injected into the compressed combustion air in the working chamber 98 via the injection nozzle 134, which fuel is then immediately ignited with the compressed air. In contrast, the working chamber 96 is then empty after the expulsion of the burnt fuel/air mixture and is ready to take in fresh precompressed combustion air from the secondary chambers 100 and 102.

The pistons 24 to 30 have moved on by now through 180° about the axis 34 of rotation in the housing 12. Consequently, the oscillating piston machine 10 carries out two complete working cycles over one complete rotation of the pistons 24 to 30 through 360° about the axis of rotation, i.e. the working cycles of taking in, compression, expansion and expulsion take place twice over one complete rotation of 360°.

Figure 11:
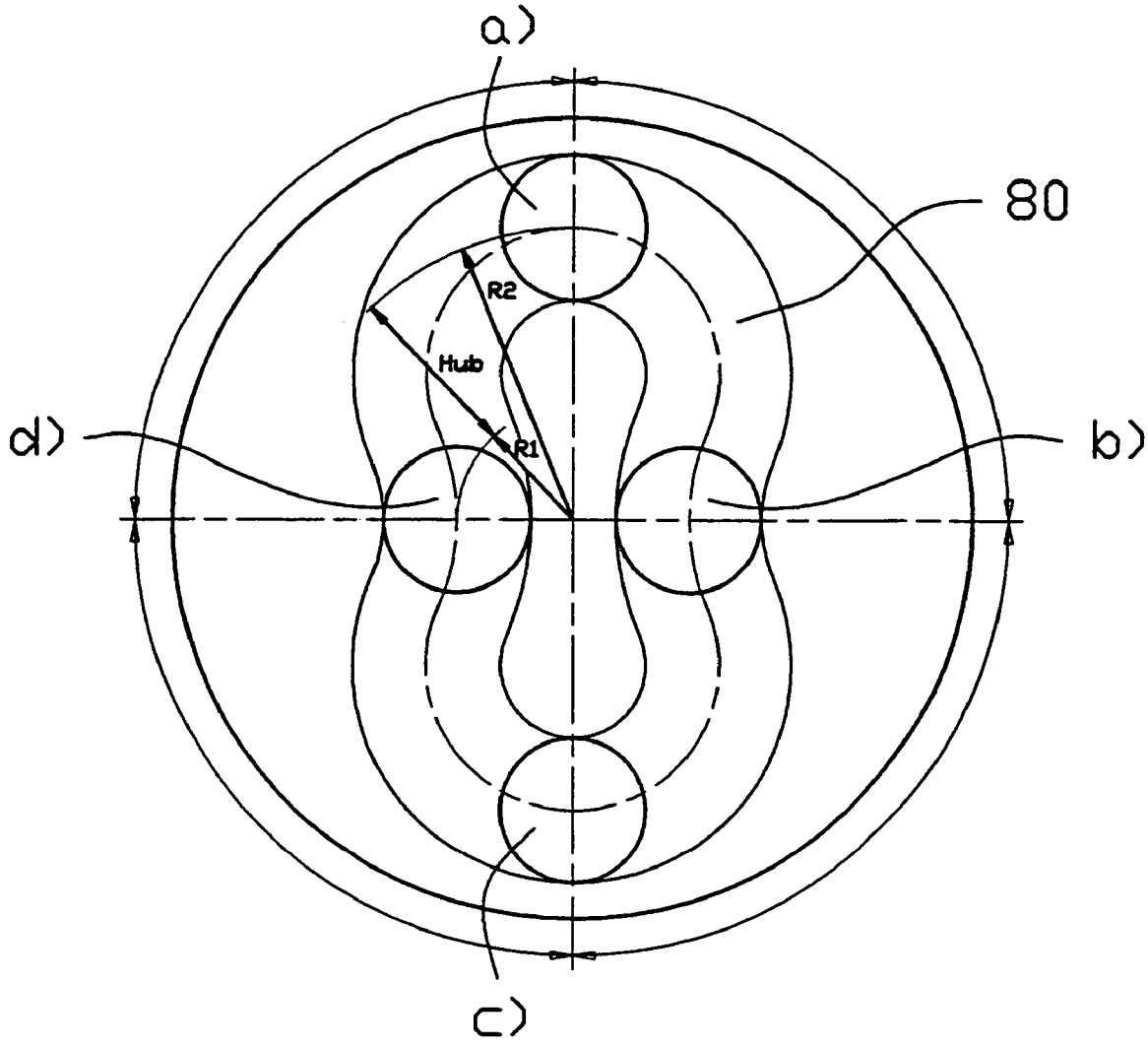
FIG. 11 shows a schematic view of the characteristic of the control cam by means of which the oscillating movements of the piston are controlled.

FIG. 11 shows the characteristic of the working curve for the guide elements 68 and 70 of the pistons 24 to 30. This representation shows that the stroke of the oscillating pistons is given by the difference between the radii R2 and R1, the radius R1 being the distance between the center point of the groove 80 and the center of the groove 80 on the short axis, and the radius R2 being the distance between the center point of the groove 80 and the center of the groove 80 on the large axis.

Figure 15:
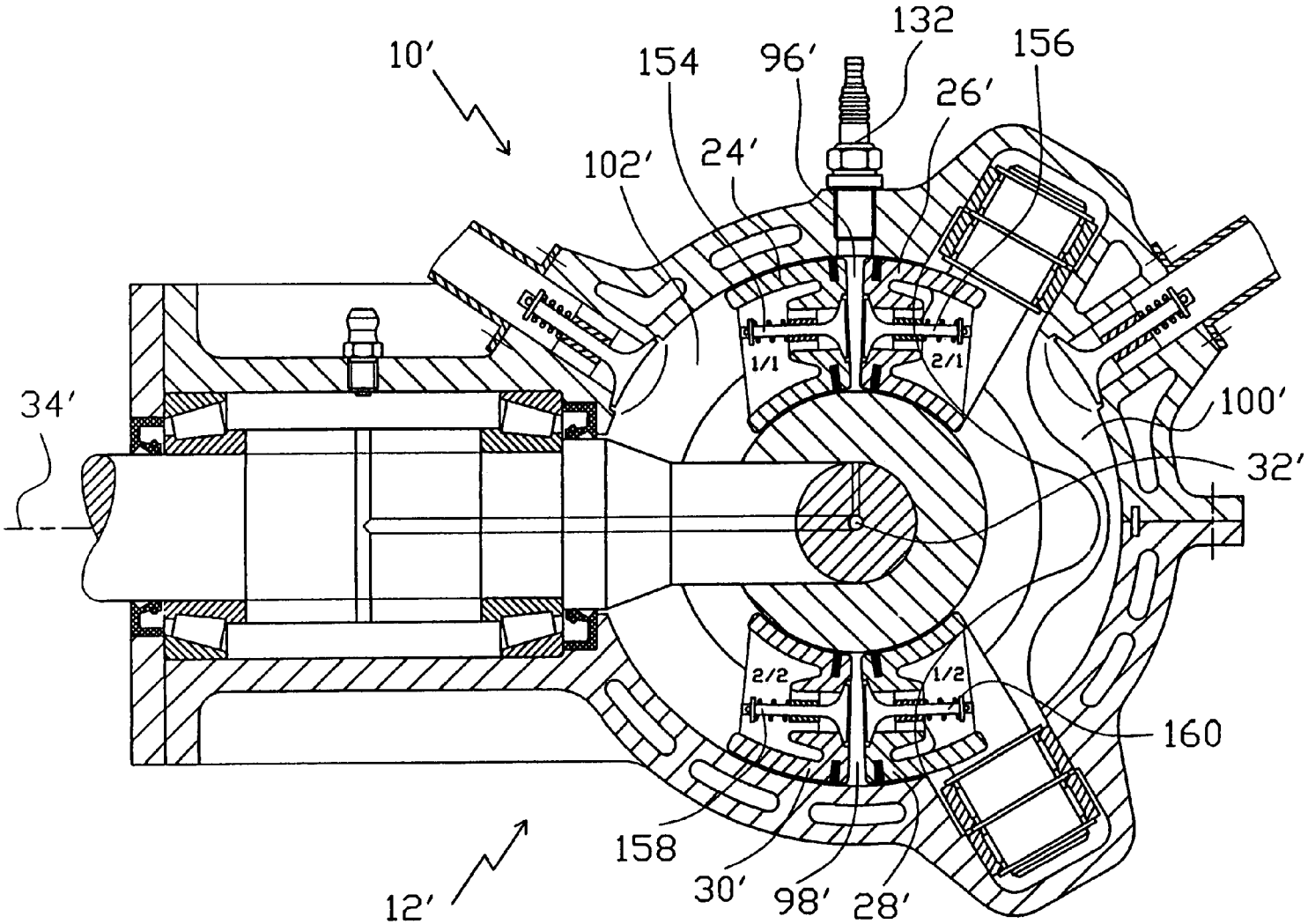
FIG. 15 shows a sectional view, corresponding to FIG. 7, of an oscillating piston machine according to an exemplary embodiment which is slightly modified with respect to the oscillating piston machine in FIG. 1.
Figure 16:
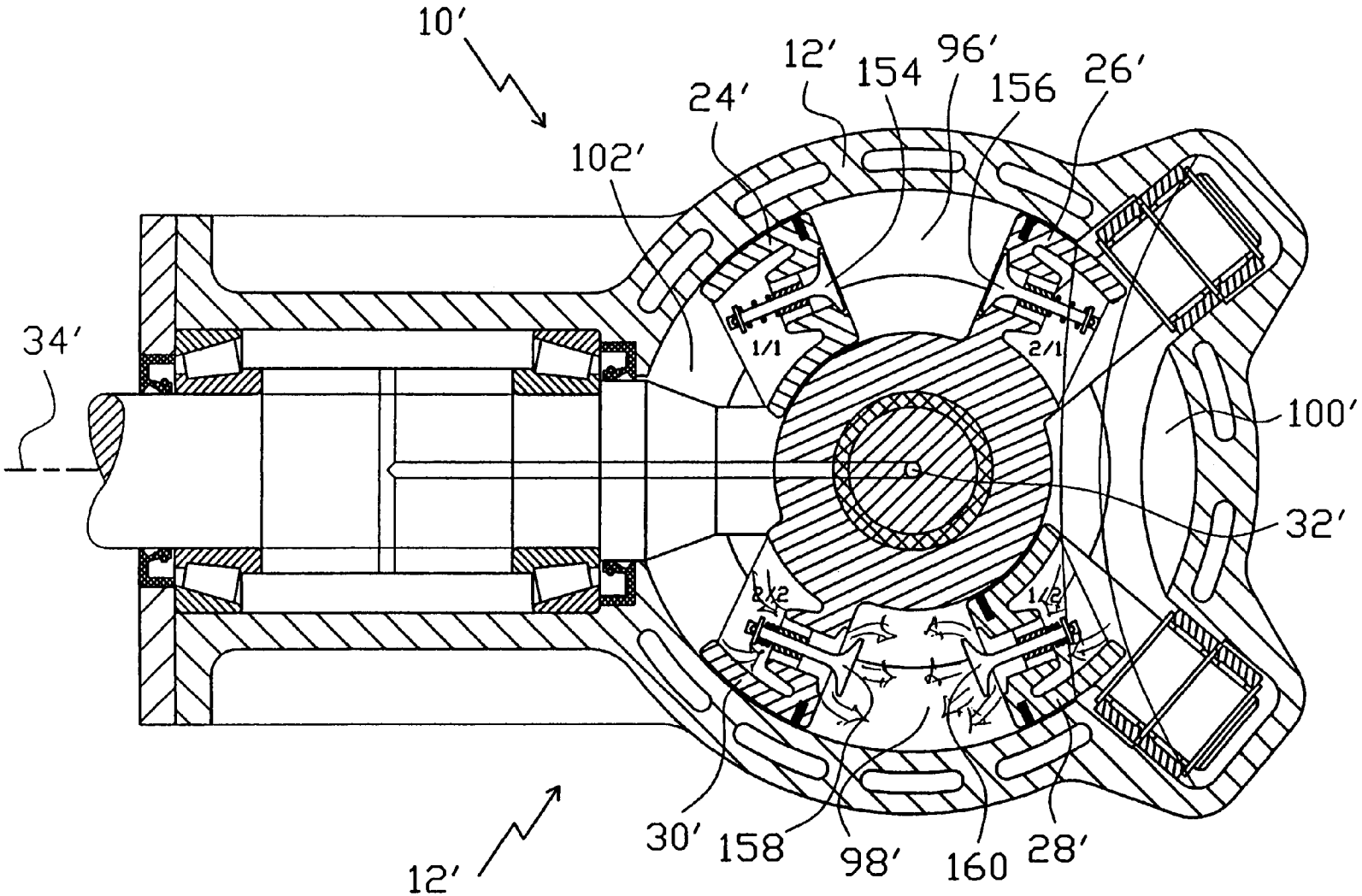
FIG. 16 shows the oscillating piston machine in FIG. 15 in an operating position of the pistons which is modified with respect to FIG. 15.
Figure 17:
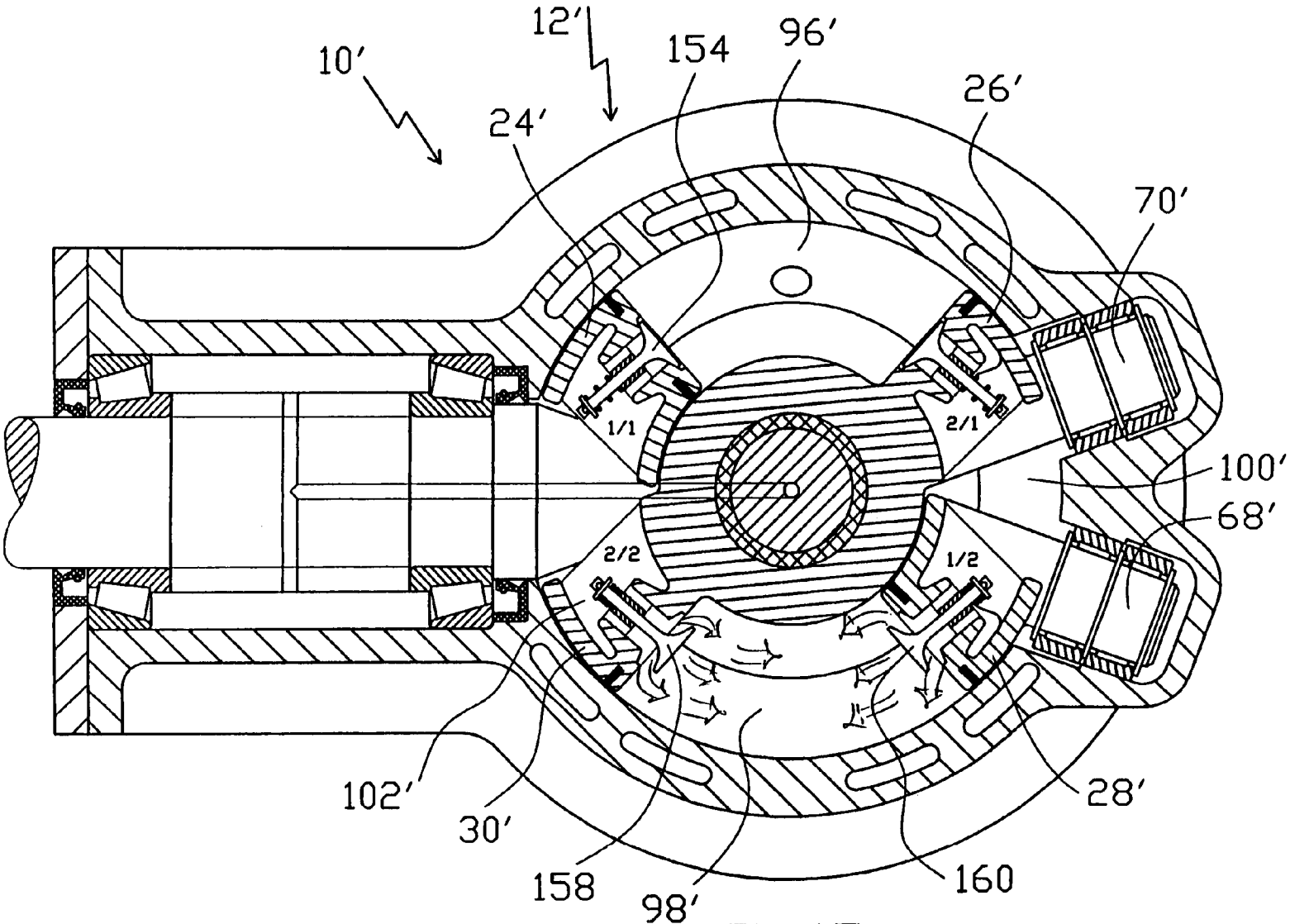
FIG. 17 shows the oscillating piston machine in FIGS. 15 and 16 in an operating position of the pistons which is modified further with respect to FIGS. 15 and 16.

FIGS. 15 to 17 show an exemplary embodiment of an oscillating piston machine 10' which is slightly modified with respect to the oscillating piston machine 10 and differs from the oscillating piston machine 10 only in the structural embodiment of the self-supercharging effect which is described above with respect to the oscillating piston machine 10.

Identical or comparable features and elements of the oscillating piston machine 10' have been provided with the same reference symbols as in the oscillating piston machine 10 together with a prime mark.

In the exemplary embodiment illustrated in FIGS. 15 to 17, the working chambers 96' and 98' do not communicate with the secondary chambers 100' and 102' via a line which is on the outside of the housing as in the preceding exemplary embodiment but rather directly via the pistons 24' to 30' themselves, an inlet valve 154 to 160 being arranged in each of them. The inlet valves 154 to 160 are embodied as butterfly valves. The inlet valves 154 to 160 open and close automatically depending on the pressure difference between the secondary chambers 100', 102' and the working chambers 96', 98' which is established during the reciprocating oscillating movements of the pistons 24' to 30'. The inlet valves 154 to 160 are prestressed in the direction of the secondary chambers 100' and 102'.

FIG. 15 shows the working chamber 96' between the pistons 24' and 26' in a position in which the pistons 24'and 26' are in the top dead center. If the fuel/air mixture present in the working chamber 96 is then ignited by means of the sparkplug 132', extremely high pressures occur in the working chamber 96' so that the inlet valves 154 and 156 remain closed against this pressure until the working chamber 96' is ready for the intake cycle again after the expulsion cycle.

FIG. 15 shows all four inlet valves 154 to 160 in their closed position. In FIG. 16, the pistons 24', 26' and 28', 30', respectively, have moved apart about the oscillation axis 32' and in doing so have moved a further 45° about the axis 34' of rotation in the housing 12'. The inlet valves 154 and 156 continue to be located in their closed position because the pressure in the working chamber 96' is still higher than in the secondary chambers 100' and 102'. In contrast, the inlet valves 158 and 160 are in their open position as the working chamber 98' which is empty in FIG. 15, and thus nonpressurized, has a lower internal pressure than the secondary chambers 100' and 102'.

From FIG. 17 it is apparent that the inlet valves 154 and 156 remain closed until the working chamber 96', in which the previously ignited fuel/air mixture expands further, has reached its maximum volume according to FIG. 17.

With respect to the oscillating movements of the individual pistons 24' to 30', FIGS. 15 to 17 are also an illustrative view of the pistons 24 to 30 in the exemplary embodiment according to FIGS. 1 to 8, said pistons moving in the same way between the end positions according to FIGS. 15 and 17, and the sequence of FIGS. 15 to 17 also additionally illustrates the control of the piston movements by means of the guide elements 68 and 70, and 68' and 70', respectively.

Figure 18:
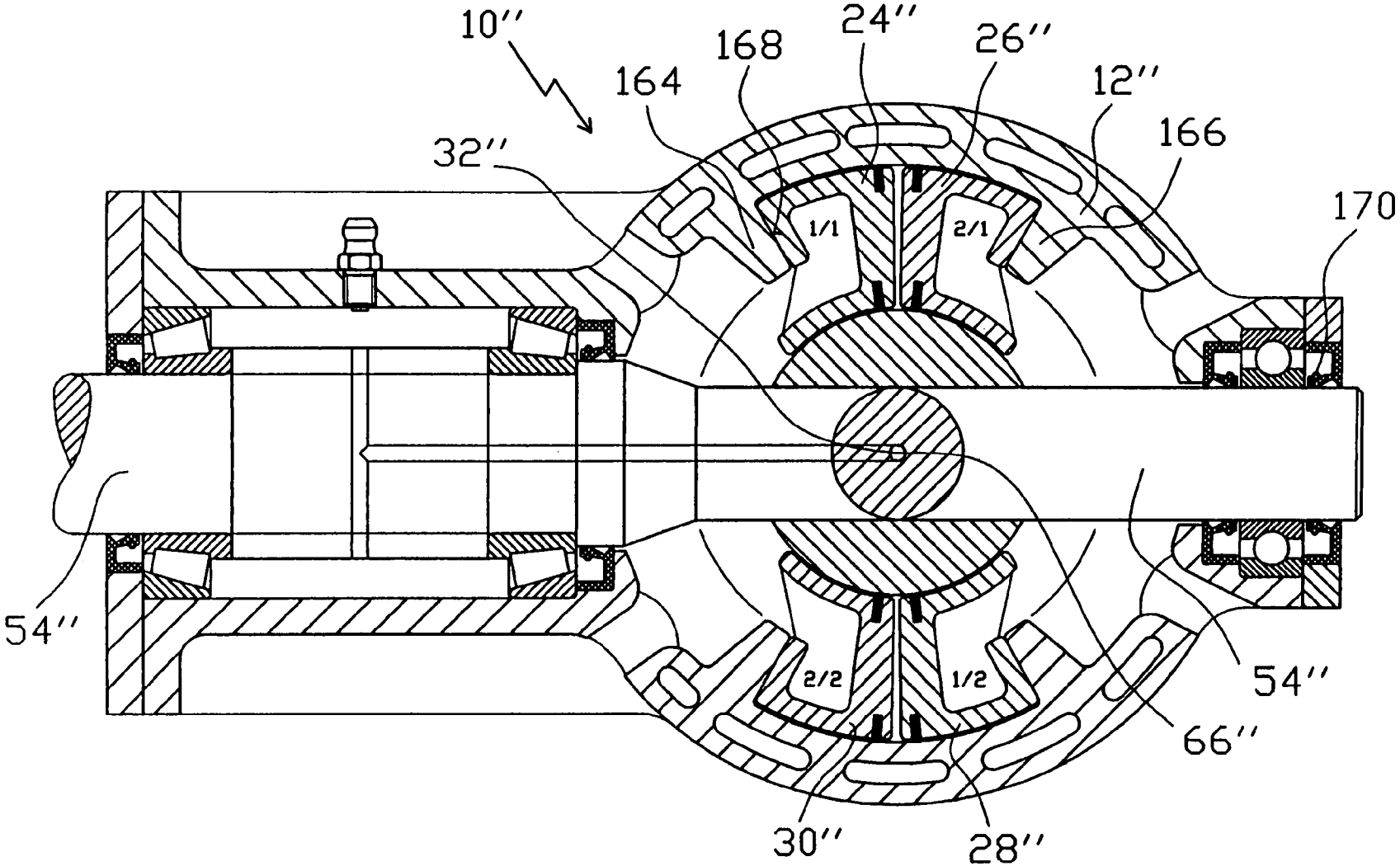
FIG. 18 shows a view, corresponding to FIG. 17, of a further exemplary embodiment of an exemplary embodiment of an oscillating piston machine which is slightly modified with respect to the oscillating piston machine in FIG. 1.

FIG. 18 shows a further exemplary embodiment of an oscillating piston machine provided with the general reference number 10", which exemplary embodiment differs from the two preceding exemplary embodiments in the manner in which the oscillating movements of the pistons 24" to 30" are controlled.

In this exemplary embodiment, the control cam curve which is provided for controlling the oscillating movements of the pistons 24" to 30" is embodied as two projections 164 and 166 which project inward from the housing 12". The projections 164 and 166 have, in contrast to the just one groove 80, an essentially elliptical form. In further contrast to the preceding exemplary embodiments, the pistons 24" to 30" are each formed with bearing faces 168 by means of which the pistons 24" to 30" are guided in a sliding fashion on the projections 164 and 166 in order to control the oscillating movements of the pistons 24" to 30". The pistons 24" to 30" are, in contrast to the preceding exemplary embodiments, thus guided on only one side so that it may be necessary under certain circumstances to force in pressurized air in the top dead center position of the respective piston pairs 24" and 26", and 28" and 30", respectively, in order to initialize the opening oscillating movement of the pistons 24" and 26".

Furthermore, in FIG. 18 the shaft 54" is mounted on the housing 12" on both sides, i.e. does not end in the center 66" of the housing as in the previous exemplary embodiments. The shaft 54" is thus also mounted on a second bearing 170.

Figure 19:
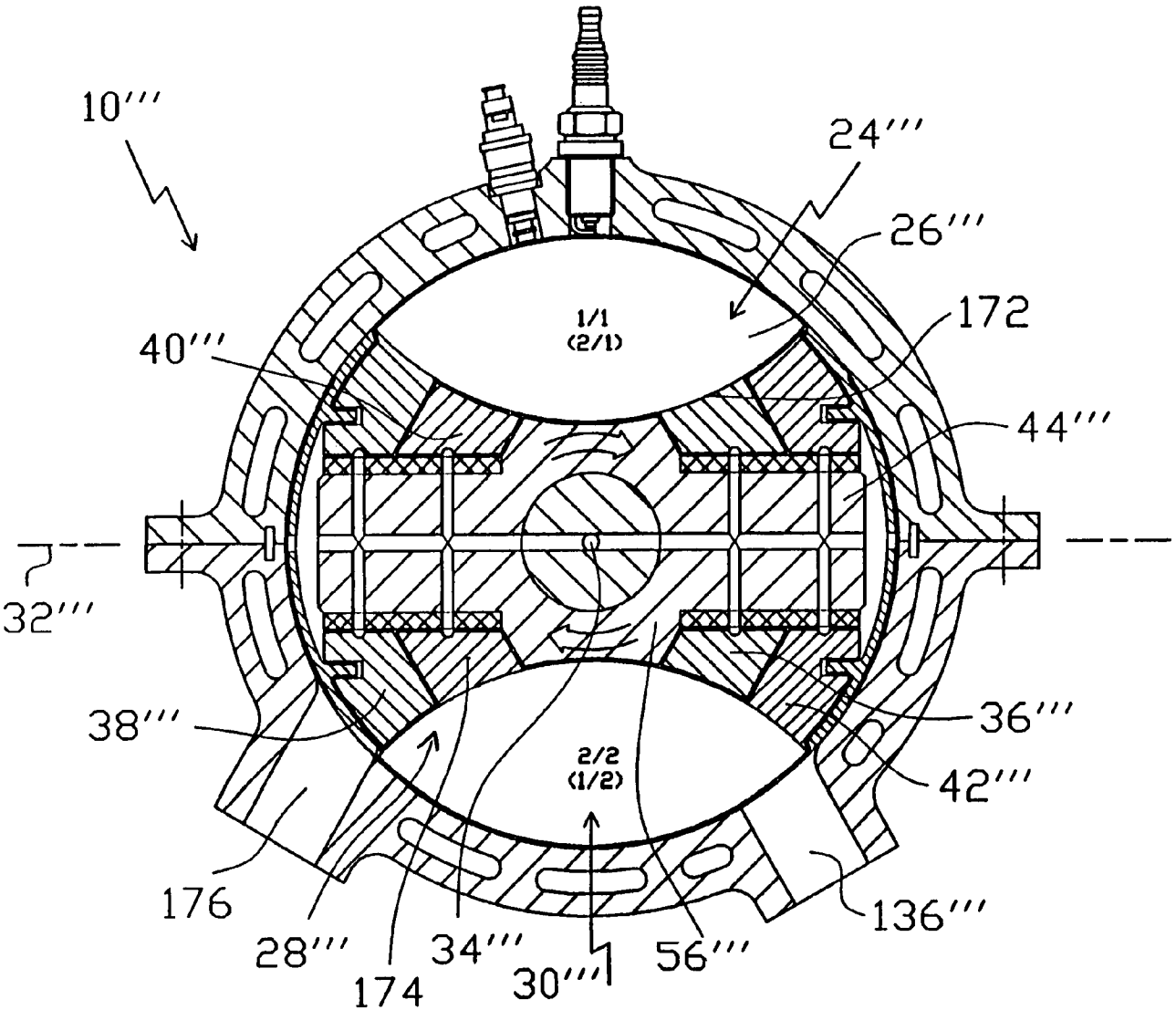
FIG. 19 shows a sectional view, corresponding to FIG. 8, of yet another exemplary embodiment of an oscillating piston machine.

Finally, FIG. 19 also shows an exemplary embodiment of an oscillating piston machine 10''', which differs in the geometry of the pistons, the pistons 26''' and 28''' of said pistons being illustrated in FIG. 19. Instead of the previous exemplary embodiments, the pistons 26''' and 28''' do not have a straight but rather a curved piston crown 172 or 174, and the bearing rings 36''' to 42''' and the ring 56''' on the shaft which forms the axis 34''' of rotation are correspondingly sloped.

Furthermore, FIG. 19 shows a variant of the oscillating piston machine 10''' in which a self-supercharging effect is not provided but instead the variant has a simple inlet duct 176. The secondary chambers which are also present in these embodiment variants can serve as oil spaces which can be flooded with oil or as air spaces which can be flooded with air in order to cool the pistons 24''' to 30'''.

It goes without saying that the previously described various exemplary embodiments can be combined with one another as desired at the discretion of the person skilled in the art.

What is claimed is:

1. An oscillating piston machine, comprising a housing having an inside of spherical construction, four pistons arranged in said housing, said four pistons being arranged to rotate together in said housing about an axis of rotation which is essentially central in said housing and is fixed with respect to said housing, and to execute reciprocating oscillating movements about a common oscillation axis running essentially through a center of said housing as said pistons rotate in said housing, wherein in each case two adjacent pistons of said four pistons execute oscillating movements in opposite directions, wherein each piston has a working side and a rear side turned away from said working side, a respective working chamber being formed in each case between two of said working sides, which respectively face one another, of two adjacent of said four pistons and said housing, while in each case a secondary chamber which increases or decreases in volume in inverse proportion to said two working chambers is formed between two respective of said rear sides of two adjacent of said four pistons and said housing, and wherein said two secondary chambers together communicate alternatively with one of said two working chambers via at least one inlet valve which permits fluid after compression in said two secondary chambers to pass from both secondary chambers into one of said two working chambers.

2. The oscillating piston machine of claim 1, wherein said common oscillation axis of said pistons runs essentially perpendicular with respect to said axis of rotation.

3. The oscillating piston machine of claim 1, wherein said pistons are mounted in a pivoting fashion on a spindle which forms said common oscillation axis and is connected, fixed in terms of rotation about said axis of rotation, to a shaft which forms said axis of rotation.

4. The oscillating piston machine of claim 3, wherein said shaft is made to lead out of said housing.

5. The oscillating piston machine of claim 3, wherein said shaft ends approximately centrally in said housing.

6. The oscillating piston machine of claim 1, wherein in each case two of said four pistons which lie essentially diametrically opposite one another with respect to said center of said housing are fixedly connected to one another to form a double piston.

7. The oscillating piston machine of claim 1, wherein as said pistons rotate in said housing, said pistons are guided along at least one control cam curve, formed on said housing, in order to control said reciprocating oscillating movements of said pistons.

8. The oscillating piston machine of claim 7, wherein said control cam curve is embodied as at least one groove which is provided in said housing and into which in each case at least one guide element which is assigned to a respective one of said pistons and fixed to said piston engages.

9. The oscillating piston machine of claim 8, wherein said guide element has at least one roller.

10. The oscillating piston machine of claim 9, wherein said guide element has two rollers, one of which is in contact with one side face of said groove and the other with the opposite side face of said groove.

11. The oscillating piston machine of claim 8, wherein said guide element has at least one sliding bearing.

12. The oscillating piston machine of claim 7, wherein said control cam curve is embodied as at least one projection which protrudes inwards from said housing and along which said pistons are guided.

13. The oscillating piston machine of claim 1, wherein two inlet valves are present on said housing in order to flood said two secondary chambers.

14. The oscillating piston machine of claim 1, wherein said two secondary chambers communicate with the respective one of said two working chambers via a line which is arranged on the outside of said housing, said at least one inlet valve through which said fluid passes into the respective one of said working chambers from said secondary chamber being arranged on said housing.

15. The oscillating piston machine of claim 1, wherein each piston has a working side and a rear side turned away from said working side, a respective working chamber being formed between two of said working sides, which respectively face one another, of two of said adjacent pistons and said housing, while in each case a secondary chamber which increases or decreases in volume in inverse proportion to said working chambers is formed between two respective ones of said rear sides of two adjacent of said pistons and said housing, and wherein said at least one secondary chamber communicates with said at least one working chamber through one of said pistons which is arranged between said at least one secondary chamber and said at least one working chamber, wherein an inlet valve through which a fluid passes into said working chamber from said secondary chamber being arranged on said intermediate piston.

16. The oscillating piston machine of claim 1, wherein said pistons are arranged in such a way that in each case two adjacent of said pistons alternately approach one another and move away from one another owing to said reciprocating oscillating movements.

* * * * *